US006450138B1

(12) United States Patent
Kinugawa et al.

(10) Patent No.: US 6,450,138 B1
(45) Date of Patent: Sep. 17, 2002

(54) VALVE TIMING ADJUSTING DEVICE

(75) Inventors: Hiroyuki Kinugawa; Hirofumi Hase, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/937,361

(22) PCT Filed: Jan. 25, 2000

(86) PCT No.: PCT/JP00/00364

§ 371 (c)(1),
(2), (4) Date: Sep. 25, 2001

(87) PCT Pub. No.: WO01/55562

PCT Pub. Date: Aug. 2, 2001

(51) Int. Cl.[7] ..... F01L 1/344

(52) U.S. Cl. ..... 123/90.17; 123/90.65; 123/90.67

(58) Field of Search ..... 123/90.15, 90.17, 123/90.31, 90.65, 90.66, 90.67

(56) References Cited

U.S. PATENT DOCUMENTS

| | | | | |
|---|---|---|---|---|
| 5,836,276 A | | 11/1998 | Iwasaki et al. | 123/90.17 |
| 5,870,983 A | * | 2/1999 | Sato et al. | 123/90.17 |
| 6,276,321 B1 | * | 8/2001 | Lichti et al. | 123/90.17 |
| 6,336,433 B1 | * | 1/2002 | Anton et al. | 123/90.17 |

FOREIGN PATENT DOCUMENTS

| | | |
|---|---|---|
| JP | 1-307530 | 12/1989 |
| JP | 8-74529 | 3/1996 |
| JP | 09-264110 | 10/1997 |
| JP | 10-68306 | 3/1998 |
| JP | 10-331613 | 12/1998 |
| JP | 11-48010 | 2/1999 |
| JP | 11-173118 | 6/1999 |
| JP | 11-210421 | 8/1999 |

* cited by examiner

*Primary Examiner*—Weilun Lo
(74) *Attorney, Agent, or Firm*—Sughrue Mion, PLLC

(57) ABSTRACT

A valve timing regulation device for regulating the timing of the opening and closing of the valves in an internal combustion engine, includes: a rotor urging member 40, 41 for urging the rotor 18 toward a predetermined lock position with respect to the housing 16; and holder members 38, 39 which support both ends of the rotor urging member 40, 41 on the wall surfaces of the shoe 22 of the housing 16 and the vane 23 of the rotor 18. Such an arrangement allows assembly of the rotor urging member 40, 41 into an advancing hydraulic chamber 24 formed between the shoe 22 and the vane 23. Thus, it is not required to provide an urging member storage chamber for assembling the rotor urging member 40, 41 as a separate component, and therefore it is possible to downsize the valve timing regulation device. Furthermore, it is possible to suppress wear on both ends of the rotor urging member 40, 41 due to friction with the shoe 22 and the vane 23 by the holder members 38, 39.

17 Claims, 16 Drawing Sheets

VALVE TIMING ADJUSTING DEVICE

This application is the national phase under 35 U.S.C. §371 of PCT International Application No. PCT/JP00/00364 which has an International filing date of Jan. 25, 2000, which designated the United States of America and was not published in English.

TECHNICAL FIELD

The present invention relates to a valve timing regulation device which automatically varies the opening and closing timing of one or both of an intake valve and an exhaust valve in response to performance conditions of an internal combustion engine.

BACKGROUND ART

A conventional valve timing regulation device is already known which comprises a camshaft for opening and closing an intake valve and an exhaust valve of an internal combustion engine, a housing provided to rotate freely on the camshaft and driven to rotate by the output of the internal combustion engine, a rotor stored in the housing to be relatively rotatable and connected to the camshaft, and a lock means which operates with a mechanical urging force to restrict the relative, rotation of the housing and the rotor and which releases the restriction by the operation of a hydraulic control force (control hydraulic pressure) in a direction against the mechanical urging force.

FIG. 1 is a schematic cross sectional view showing the structure of a general internal combustion engine. In the figure, reference numeral 1 denotes a cylinder of an internal combustion engine, 2 is a piston which undergoes reciprocal motion in the cylinder 1, 3 is a crankshaft which is rotated by the reciprocal motion of the piston 2, 4 is a combustion chamber which combusts and explodes a gaseous mixture, 5 is an ignition plug which ignites the compressed gaseous mixture in the combustion chamber 4 with a spark, 6 is an air intake passage which supplies a gaseous mixture to the combustion chamber 4, 7 is an exhaust passage which exhausts the gases combusted in the combustion chamber 4, 8 is an intake valve which opens and closes the air intake passage 6, 9 is an exhaust valve which opens and closes the exhaust passage 7, 10*a* is a camshaft near the air intake. The air intake camshaft 10*a* has a cam 11*a* which drives the opening and closing of the intake valve 8, 11*b* is a camshaft near the exhaust and has a cam 11*b* which drives the opening and closing of the exhaust valve 9. 12*a* is a timing pulley or a timing sprocket near the air intake which is rotatably fitted and retained on the air-intake camshaft 10*a*. 12*b* is a timing pulley or a timing sprocket near the exhaust which is rotatably fitted and retained on the exhaust camshaft 11*b*. 13 is a timing chain or a timing belt which links the timing pulley or the timing sprocket 12*a*, 12*b* with the crankshaft 3.

A valve timing regulation device is provided in the air-intake camshaft 11*a* and the exhaust camshaft 11*b* of the internal combustion engine.

FIG. 2 is a cross sectional view in an axial direction of a first conventional valve timing regulation device as disclosed for example in JP-A-10-68306. The first conventional valve timing regulation device regulates the opening and-closing timing of the exhaust valve 9 in FIG. 1. In FIG. 2, those components which are the same as or similar to those shown in FIG. 1 are designated by the same reference numerals.

In FIG. 2, reference numeral 14 denotes a fixed camshaft sleeve securely fitted with a camshaft 10*b* near an exhaust (hereafter this will simply be referred to as camshaft). The timing pulley 12*b* near the exhaust is arranged rotatably on the camshaft 10*b* through the camshaft sleeve 14. Thus, the camshaft 10*b* and the camshaft sleeve 14 rotate together. The timing pulley 12*b* rotates relative to the camshaft 10*b*.

12*c* is a projection for catching the spring thereon, which is integrally formed on one face of the timing pulley 12*b* and projects therefrom. 15 is a spiral spring, an outer radial side end portion of which is hung on the projection 12*c* and an inner radial side end portion of which is hung on the camshaft sleeve 14. The spiral spring 15 urges the rotor 18 (discussed hereafter) in an advancing direction, the urging force is set to be greater than the maximum torque when the internal combustion engine is started.

16 is a housing which is fixed by a bolt 17 on the timing rotation body 12*b*, 16*a* is an annular partition which is formed in the middle of an inner peripheral surface of the housing 16. An internal section of the housing 16 is partitioned by the partition 16*a* into a rotor storage chamber 16*b* on one axial end and a spring storage chamber 16*c* on the other axial end. The spiral spring 15 is stored in the spring storage chamber 16*c*.

18 is a rotor which is rotatably stored in the rotor storage chamber 16*b* of the housing 16. The rotor 18 is fixed with an axial bolt 19 to an end portion of the camshaft 10*b* and is adapted to rotate together with the camshaft 10*b*. Thus, the housing 16 and the rotor 18 can rotate relative to one another.

20 is a covering member which covers the open end of the housing 16 and is fixed with a bolt 21to the housing 16.

FIG. 3 is a cross sectional view of the first conventional valve timing regulation device along the line A—A in FIG. 2. In the figure, reference numeral 22 denotes a plurality of shoes which project from an inner peripheral surface of the housing 16. The shoes 22 are integrated with the housing 16, the tips of the shoes 22 are in slide contact with the rotation body of the rotor 18. Reference numeral 23 denotes a plurality of vanes which project from an outer peripheral surface of the rotor 18 and extend in a radial direction. These vanes are integrated with the rotor 18, the tips of the vanes 23 are respectively in slide contact with the inner peripheral surface of the housing 16 between the shoes 22. An advance hydraulic chamber 24 and a retard hydraulic chamber 25 each having a fan-shaped space is formed between the shoes 22 and the vanes 23. A hydraulic oil is supplied from the hydraulic control system (not shown) to the advance hydraulic chamber 24 and the retard hydraulic chamber 25 in accordance with the operation condition of the internal combustion engine.

As described above, the first conventional valve timing regulation device is provided with a lock mechanism (not shown) for locking the rotor 18 at a maximum advance position with respect to the housing 16. The lock mechanism includes a stopper which is contained in the rotor 18 to be displaceable in its axial direction and a stopper hole which is formed on a cover member to engage and disengage with the stopper. The lock mechanism is also provided with a valve timing regulation mechanism on the air intake side which regulates the opening and closing timing of the intake valve 8 in FIG. 1. The lock mechanism of the intake side valve timing regulation device is adapted to lock the rotor at a maximum retard position in an opposite manner to that of the exhaust side valve timing regulation device.

Next, the operation of the first conventional valve timing regulation device will be described below.

Firstly, in FIG. 1, a rotational force of the crankshaft 3 is transmitted respectively to the intake side camshaft 11*a* and the exhaust side camshaft 11*b* through the timing pulleys 12*a,* 12*b* by the timing belt 13 during operation of the internal combustion engine. At this time, the rotor 18 and the housing 16 as shown in FIG. 2 and FIG. 3 are in a lock released state. The opening and closing timing of the intake valve 8 and the exhaust valve 9 in FIG. 1 is regulated by the relative rotation of the housing 16 and the rotor 18 due to a pressure differential of the advance side hydraulic chamber 24 and the retard side hydraulic chamber 25 to which a hydraulic oil is supplied from the hydraulic control system in accordance with the operation condition of the internal combustion engine.

When the internal combustion engine is stopped after operating, a rotational reaction force in the retarding direction is generated respectively to the intake side camshaft ha and the exhaust side camshaft 11*b* shown in FIG. 1. The lock position of the air-intake side camshaft 11*a* is set to a maximum retarded position and the lock position of the exhaust side camshaft 11*b* is set to a maximum advanced position. Therefore, when the internal combustion engine is stopped, although the intake side camshaft 11*a* is locked in the maximum retarded position, the exhaust side camshaft 11*b* tends to rotate in the retarding direction which is the opposite direction to the locked position. In this case, the exhaust side camshaft 11*b* is urged in the advancing direction by the spiral spring 15 through the rotor 18 which rotates together with the exhaust side camshaft 11*b*. Therefore, the exhaust side camshaft 11*b* is not affected by the rotational reaction force when the internal combustion engine is stopped, the rotor 18 is locked in the housing 16 by the locking mechanism at the maximum advanced position. In such a way, the housing 16 and the rotor 18 can rotate together when the internal combustion engine is started.

Since the first conventional valve timing regulation device is constructed above, in order to allow assembly of the spiral spring 15, it is necessary to integrate the projection 12*c* on the stem of the timing pulley 12*b* and to form the camshaft sleeve 14 as a separate component from the camshaft 10*b*. Furthermore, it is necessary to form a spring storage chamber 16*c* separated from the rotor storage chamber 16*b* by the partition 16*a* in the housing 16 in order to maintain an assembly space for the spiral spring 15. Therefore, problems related to structural complexity and increases in costs have arisen. In particular, when assembling the spiral spring 15, one end is attached to the projection 12*c* and the other end is attached to the camshaft sleeve 14 while the spiral spring 15 is twisted. Thus, assembly of the spiral spring 15 is complicated to an extreme degree by the generation of a torsional reactive force in the spiral spring 15 during attachment. Moreover, by the reactive torsion force of the spiral spring 15, the spiral spring 15 itself becomes entangled, and further, the vanes 23 of the rotor 18 become inclined or undergo a positional deviation in the radial direction. This increases a sliding resistance between the rotor 18 and the housing 16. Such problems have arisen with respect to assembly accuracy land assembly operations for the spiral spring 15. Furthermore, the problem has also arisen of increases in rotation resistance of the camshaft 10*b* by the sliding contact of the spiral spring 15 after assembly with the lateral face of the timing pulley 12*b* or the partition 16*a* of the housing 16.

FIG. 4 is a cross sectional view along an axial direction showing the structure of a second conventional valve timing regulation device as disclosed for example in JP-A-10-68306. FIG. 5 is a cross sectional view of the second conventional valve timing regulation device along the line B—B in FIG. 4. Those components which are the same as or similar to those in FIG. 1 to FIG. 3 are denoted by the same reference numerals and additional description will be omitted. In the figure, reference numeral 26 denotes a rear plate having a boss portion which is rotatably fitted on an outer periphery of a camshaft sleeve 14. The rear plate 26 is fixed integrally with the timing pulley 12*b,* the housing 16 and the cover member 20 by a bolt 17*a*. 26*a* is a projection for catching the spring thereon, which projects from a lateral face of the flange of the rear plate 26. The projection 26*a* is integrated with the flange of the rear plate 26. 27 is a torsion spring which urges the camshaft 10*b* in its advancing direction, the torsion spring 27 is inserted into a ring-shaped space formed between an outer peripheral surface of the camshaft sleeve 14 and an inner peripheral surface of the boss portion of the rear plate 26. One end of the torsion spring 27 is attached to the camshaft sleeve 14 and the other end is attached to the projection 26*a*. Since the operation of this second conventional example is the same as that of the first conventional example, further description will be omitted.

Since the second conventional valve timing regulation device is constructed as above, it is necessary to form the rear plate 26 separately as an assembly component for the torsion spring 27. As a result, the number of components and the number of component assembly steps are increased, thereby to increase the cost. Furthermore, assembly of the torsion spring 27 is extremely complicated. In particular, since the assembled torsion spring 27 is in slide contact with the outer peripheral surface of the camshaft sleeve 14 and the inner peripheral surface of the boss portion of the rear plate 26, the problem has arisen that the sliding resistance of the torsion spring 27 is increased, thereby to affect the opening and closing timing of the valve.

FIG. 6 is a cross sectional view along an axial direction of a third conventional valve timing regulation device as disclosed for example in JP-A-10-68306. Those components which are the same as or similar to those in FIG. 1 to FIG. 5 are denoted by the same reference numerals and additional description will be omitted. In the figure, reference numeral 22*a* denotes a shoe side concavity which is provided on a peripheral end face towards an advancing direction in each shoe 22 of the housing 16. 23*a* is a vane side concavity which is provided on a peripheral end face towards a retarding direction in each vane 23 of the rotor 18. 28 is a coil spring both ends of which are directly fitted into the shoe side concavity 22*a* and the vane side concavity 23*a*. The spring 28 urges the rotor 18 in the advancing direction with respect to the housing 16. Thus, in the third conventional example as well, the rotor 18 is displaced in a rotational direction to a maximum advanced position by the urging force of the spring 28 when the internal combustion engine is stopped, and the rotor 18 is locked with respect to the housing 16 at the maximum advanced position.

Since the third conventional valve timing regulation device is constructed as above, it is necessary to fit both ends of the spring 28 directly into the shoe side concavity 22*a* and the vane side concavity 23*a* in the advancing hydraulic chamber 24 from a peripheral direction while compressing the spring 28. Thus, the problem has arisen that there is a high probability of reductions in assembly productivity of the spring 28 due to the generation of a curvature or a compressive reaction force of the spring 28 when fitting the spring. In particular, since, as stated above, both ends of the spring 28 are directly fitted to the shoe side concavity 22*a* and the vane side concavity 23*b,* there is a high probability of wear being caused in the fitting portion of the spring 28 by the friction between the spring 28 and the inner walls of the shoe side concavity 22*a* and the vane side concavity 23*b*. Furthermore, the problem has arisen that there is a high probability of generating a positional deviation of the spring, thereby causing detachment of the spring 28 from the shoe side concavity 22*a* and/or the vane side concavity 23*b* or causing the wear in contact with the covering components in the axial direction which constitute the hydraulic chamber.

The present invention is proposed to solve the above problems and has the object of providing a valve timing regulation device which can improve assembly productivity of the rotor urging member for urging the rotor in a direction opposite to the rotational reactive force generated on the camshaft when the internal combustion engine is stopped, and which can prevent wear of the rotor urging members.

Further, it is an object of the present invention to provide a valve timing regulation device which allows simple and well-balanced assembly of the rotor urging member so that the rotor in the housing does not undergo a positional deviation in an axial or radial direction, thereby to improve both of the assembly productivity and the assembly accuracy and to simplify the component structure.

Furthermore, it is an object of the present invention to provide a valve timing regulation device which can ensure retention of the holder members, which support both ends of the rotor urging member, on the vane of the rotor and the shoe of the housing.

Furthermore, it is an object of the present invention to provide a valve timing regulation device which allows simple formation of the holder members.

Furthermore, it is an object of the present invention to provide a valve timing regulation device which enables the rotor urging member to display a buffering function by the holder members.

Further, the present invention has the object of providing a valve timing regulation device which allows mass production of the holder member having sufficient mechanical strength, and allows cost reductions and improvements in productivity.

Furthermore, the present invention has the object of providing a valve timing regulation device which allows simple assembly of a plurality of rotor urging members, which is united with the holder member, into the same hydraulic chamber, and which allows further, improvements to assembly accuracy without entanglement of the plurality of rotor urging members.

Furthermore, the present invention has the object of providing a valve timing regulation device, which ensures sufficient mechanical strength of the shoes and the vanes to which the rotor urging member is attached.

Furthermore, the present invention has the object of providing a valve timing regulation device, which allows further simplification in the assembly of the holder members united with the rotor urging member.

Furthermore, the present invention has the object of providing a valve timing regulation device, which allows downsizing the device by disposition of the rotor urging member in the advancing hydraulic chamber.

Furthermore, the present invention has the object of providing a valve timing regulation device which allows simple attachment of the holder members, which are formed as a unit together with the rotor urging member, to the vanes and the shoes, and allows improvement of the reliability of the device by preventing the holder members from detaching from the shoes and the vanes.

DISCLOSURE OF THE INVENTION

According to the present invention, there is provided a valve timing regulation device including: a camshaft which drives the opening and closing of valves in an internal combustion engine; a housing which has a plurality of shoes on an inner peripheral face, the housing being arranged to rotate freely on the camshaft and rotated with the output of the internal combustion engine; a rotor having a plurality of vanes which define a retarding hydraulic chamber and an advancing hydraulic chamber in cooperation with the wall surfaces of the shoes directed to a circumferential direction, the rotor being stored in the housing to rotate relative to thes housing and coupled to the camshaft; and a lock means which is operated by a mechanical urging force and restricts the relative rotation of the rotor and the housing, the lock means releasing the restriction by operation of a hydraulic pressure in a direction against the mechanical urging force, the valve timing regulation device further comprising: a rotor urging member disposed between the wall surfaces of the shoes and vanes directed to the circumferential direction for urging the rotor in a rotational direction towards a predetermined lock position with respect to the housing; and a pair of holder members mounted on the wall surfaces of the shoes and vanes for supporting both ends of the rotor urging member.

In such a valve timing regulation device, since the ends of the rotor urging member are supported on-the wall surfaces of the shoe of the housing and the wall surfaces of the vane of the rotor through the holder members, it is possible to prevent wear of the rotor urging member due to friction with the walls of the shoes and vanes. Further, since a unit of the rotor urging member and the holder members is attached utilizing the hydraulic chambers which is formed between the shoes and the vanes, it is not required to provide a separate space to allow attachment of this unit, and thus, it is possible to downsize the valve timing regulation device and simplify its structure.

The valve timing regulation device of the present invention may be adapted so that an even number groups of advancing hydraulic chambers and retarding hydraulic chambers are formed between the wall surfaces of the vanes and the shoes, the rotor urging member is arranged in a pair of the advancing hydraulic chambers situated in an axial symmetry position of the rotor, and both ends of the rotor urging member are supported by the pair of holder members mounted on the wall surfaces of the vane and shoe which are disposed on both sides of the advancing hydraulic chamber to sandwich the rotor urging member.

In such a valve timing regulation device, since a unit of the rotor urging member and the holder members disposed on both ends thereof is attached only in the advancing hydraulic chambers arranged in an axial symmetry position of the rotor, it is possible to reduce the number of the holder members and the rotor urging members to be used, and to improve balance of the urging force on the rotor. As a result, it is possible to suppress entanglement and inclination of the rotor.

In the valve timing regulation device of the present invention, a holder engagement portion for fitting the holder member may be formed on the wall surfaces of the vane and the shoe directed toward the circumferential direction.

In such a valve timing regulation device, the valve timing regulation device allows simple assembly of the rotor urging member by merely fitting the holder members, which is united with the rotor urging member, into the holder engagement portions of the vane and the shoe. This allows improvements in assembly productivity and also ensures support of the holder members disposed on both end portions of the rotor urging member.

In the valve timing regulation device of the present invention, the holder members may be integrally formed with a resin material to have an engagement projection or an engagement hole which is fitted with the end portion of the rotor urging member.

In such a valve timing regulation device, since the holder member is formed from an integrated resin component, it is possible to improve the productivity and reduce the cost. Furthermore, the holder members and the rotor urging member can be easily assembled as a unit by merely fitting both ends of the rotor urging member with the engagement hole or the engagement projection of the holder members.

In the valve timing regulation device of the present invention, the holder member may be integrally formed with a resilient member such as hard rubber and have an engagement hole or an engagement projection enabling fitting of both ends of the rotor urging member.

In such a valve timing regulation device, since the holder member is formed with an integrated component of the resilient member such as hard rubber, it is possible to improve the productivity and reduce the cost. Further, the holder members and the rotor urging member can be easily assembled as a unit by merely fitting both ends of the rotor urging member into the engagement hole or the engagement projection of the holder members. Furthermore, it is possible to display a buffer function of the rotor urging member sufficiently by the provision of the holder members.

In the valve timing regulation device of the present invention, the holder members may be formed with a pressed sheet metal member.

In such a valve timing regulation device, it is possible to effect mass production of the holder members by a pressing process of the metal plate. Furthermore, it is possible to ensure a sufficient mechanical strength for the holder members.

In the valve timing regulation device of the present invention, the holder members, which have an engagement hole or an engagement projection to fit with the end portions of the rotor urging member, may be integrally formed by a molding process such as casting or forging of a metallic material.

In such a valve timing regulation device, since the holder member is formed as a metallic molded component by a process such as forging or casting of the metallic material, it is possible to improve the productivity and reduce the cost. Furthermore, it is possible to easily assemble the rotor urging member and the holder members as a unit by merely fitting both ends of the rotor urging member into the engagement hole or the engagement projection of the holder members.

In the valve timing regulation device of the present invention, the rotor urging member may be at least two coil springs, both ends of which are supported by a pair of holder members and which are stored in the same advancing hydraulic chamber, the coil springs having coil wire diameter different from each other.

In such a valve timing regulation device, the coil springs, which are arranged in parallel and supported at both ends by a pair of holder members, have different size in diameter of coil wire from; each other, and thus the coil springs are also different in coil pitch (wire-to-wire distance) from each other. Thus, even in the unlikely event that the parallel springs, which are assembled as a unit together with the holder members, undergo a bending compression, the springs do not become entangled. Therefore, it is possible to further improve assembly accuracy by suppression of meshing or inclination of the rotor as a result of such entangling.

In the valve timing regulation device of the present invention, the rotor urging member which is supported at both ends by a pair of holder members and is stored in the same advancing hydraulic chamber may be constituted by at least two coil springs with different number of turns.

In such a valve timing regulation device, since the coil springs, which are arranged in parallel and supported at both ends by a pair of holder members, are formed with the different number of turns, the coil pitch (wire-to-wire distance) in respective coil springs is also different. Thus, even in the unlikely event that the parallel springs, which are assembled as a unit together with the holder members, undergo a bending compression, the springs do not become entangled. Therefore, it is possible to further improve the assembly accuracy by suppression of meshing or inclination of the rotor as a result of such entangling.

According to the present invention, the valve timing regulation device may be adapted so that the peripheral lengths of the shoes and vanes to be disposed on both sides of the advancing hydraulic chambers which store the rotor urging member, is longer than those of the shoes and vanes to be disposed on both sides of the other advancing hydraulic chambers which do not store the rotor urging member.

In such a valve timing regulation device, since the peripheral lengths of the shoes and the vanes to be disposed on both sides of the advancing hydraulic chambers which stores the rotor urging member is longer than those of the shoes and the vanes to be disposed on both sides of the other advancing hydraulic chambers which do not store the rotor urging member, it is possible to ensure a sufficient mechanical strength for the shoes and the vanes on which the holder members supporting both ends of the rotor urging member are attached.

According to the present invention, the holder engagement portion may be formed as axial grooves, which allow insertion of the holder members from one axial end.

In such a valve timing regulation device, when mounting the unit of the rotor urging member and the holder members, it is possible to attach the unit of the rotor urging member and the holder members efficiently and easily by merely inserting the holder members from one axial end into the axial grooves formed on the wall surfaces of the shoe and the vane oriented to the circumferential direction. Thus, assembly productivity is further improved. Further, as described above, since the holder members are attached by direct insertion into the axial grooves of the shoe and the vane, a separate component for assembly is not necessary. Thus, the structure can be simplified and cost reductions can be realized. Furthermore, the valve timing regulation device can be downsized.

According to the present invention, the holder engagement portion may be formed as holes which are opened in the wall surfaces of the shoe and the vane.

In such a valve timing regulation device, when mounting the unit of the rotor urging member and the holder members, it is possible to attach the unit of the rotor urging member and the holder members efficiently and easily by fittingly inserting the holder members into the holes opened on the wall surfaces of the shoe and the vane oriented to the circumferential direction. Thus, assembly productivity is further improved. Further, since a separate component is not required for mounting the holder members as this is in the form of the holes provided on the wall surfaces of the shoe and vane, the structure can be simplified by the reduction in component number and cost reductions can be realized. Furthermore, the valve timing regulation device can be downsized.

According to the present invention, the valve timing regulation device may be adapted so that the holder engagement portion is formed as axial grooves which allow insertion of the holder members from one axial end, and a holder detachment prevention means is provided on at least one of the axial grooves and the holder members, the holder detachment prevention means limiting the displacement of the holder members in the axial grooves with respect to a rotation direction of the device.

In such a valve timing regulation device, even if vibration or an unlikely unforeseen event occurs, detachment of the holder members in the rotation direction of the device is not possible and accurate operation of the device can be ensured.

In the valve timing regulation device of the present invention, the holder detachment prevention means may bed formed by a tapering face provided on a lateral wall surface of the holder engagement groove to gradually narrow the groove width of the holder engagement groove towards an opened end of the groove, and an another tapering face provided on a lateral wall surface of the holder member in alignment with the tapering face.

In such a valve timing regulation device, the holder detachment prevention means can be provided easily by merely forming the lateral wall surfaces of the holder members and the holder engagement grooves in a tapering shape. Thus, even if vibration or an unlikely unforeseen event occurs, detachment of the holder members in the rotation direction of the device is not possible and accurate operation of the device can be ensured.

In the valve timing regulation device of the present invention, the holder detachment prevention means may be formed as a catch for preventing detachment which engages with the holder member disposed in the holder engagement groove, the catch being arranged in an opened end of the respective holder engagement grooves of the shoe and the vane.

In such a valve timing regulation device, the holder detachment prevention means can be provided easily by merely forming the catch in the opened end of the respective holder engagement grooves of the shoe and the vane. Thus, even if vibration or an unlikely unforeseen event occurs, detachment of the holder members in the rotation direction of the device is not possible and accurate operation of the device can be ensured.

In the valve timing regulation device of the present invention, the holder detachment prevention means may be formed by engagement concavities arranged on one of the holder, members and the holder engagement grooves of the shoe and the vane, and engagement protrusions arranged on the other of the holder members and the holder engagement grooves, the engagement concavity and the engagement protrusion being engaged with each other.

In such a valve timing regulation device, the holder detachment prevention means can be provided easily by merely forming the engagement concavities on one of the holder members and the holder engagement grooves and the engagement protrusions on the other of the holder members and the holder engagement grooves. Thus, even if vibration or an unlikely unexpected event occurs, detachment of the holder members in the rotation direction of the device is not possible and accurate operation of the device can be ensured.

In the valve timing regulation device of the present invention, the holder detachment prevention means may be formed by key grooves formed on both of the holder members and the holder engagement grooves of the shoe and vane, and a key member inserted into both key grooves.

In such a valve timing regulation device, it is possible to fix the holder members in the holder engagement grooves by merely inserting the key member into both key grooves of the holder member and the holder engagement groove. Thus, even if vibration or an unlikely unexpected event occurs, detachment of the holder members in the rotation direction of the device is not possible and accurate operation of the device can be ensured.

BEST MODE FOR CARRYING OUT THE INVENTION

In order to describe the present invention in greater detail, the present invention will be described with reference to the accompanying figures.

Embodiment 1

Figure 7:
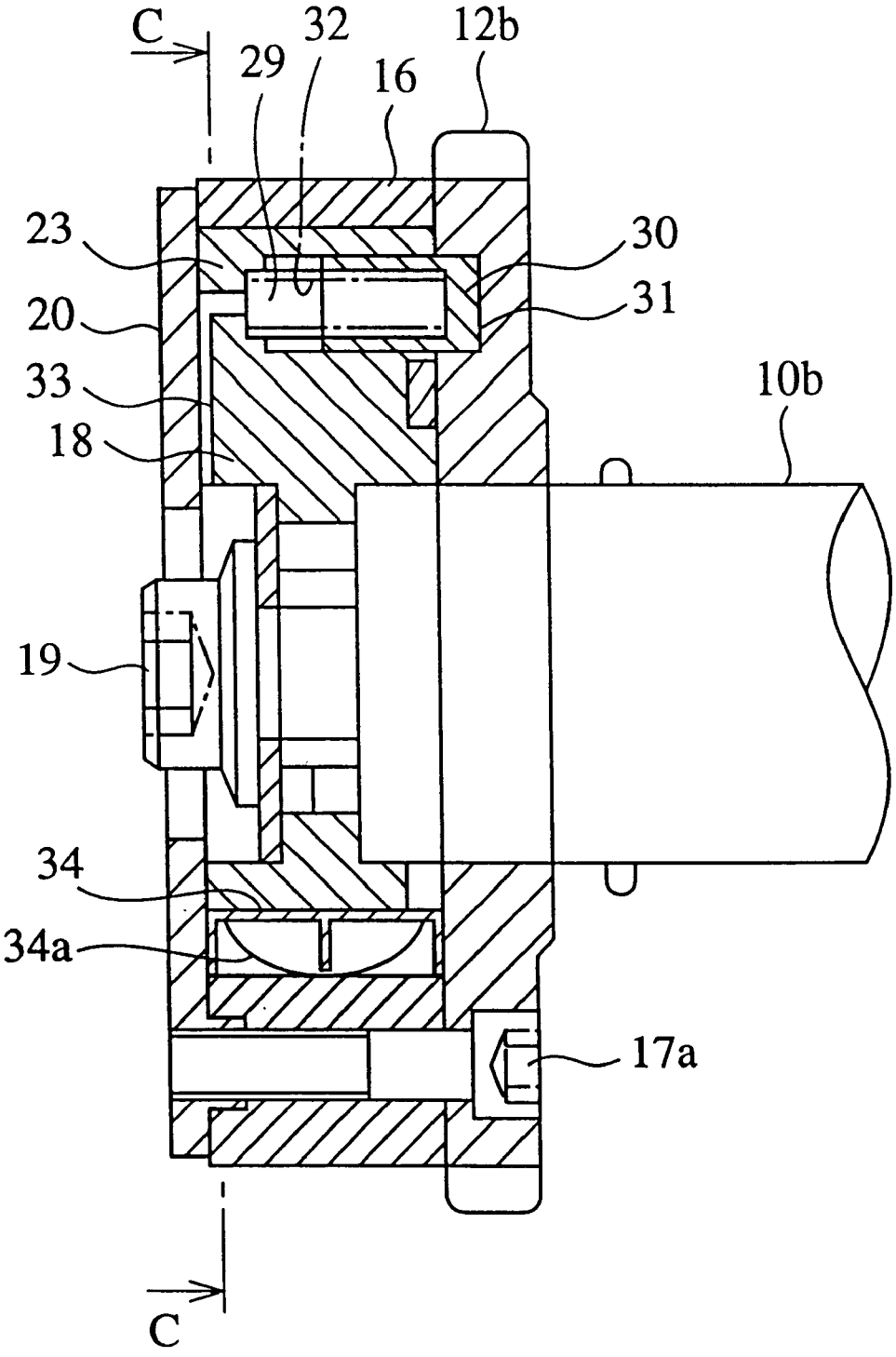
FIG. 7 is a cross sectional view along an axial direction of a valve timing regulation device according to a first embodiment of the present invention.

FIG. 7 is a cross sectional view along an axial direction of a valve timing regulation device according to a first embodiment of the present invention. Those components which are the same as or similar to components in FIG. 1 to FIG. 6 are designated by the same reference numerals and additional description will be omitted.

In FIG. 7, reference numeral 29 denotes a pin hole which is formed in an axial direction on one vane 23 of the rotor 18. 30 is a lock pin which is inserted into the pin hole 29 so as to slide therein. 31 is a lock hole which is provided in a timing sprocket or a timing pulley 12*b* (hereafter timing rotation body). The lock hole 31 is detachably fitted to the lock pin 30 at a maximum advanced position of the rotor 18 with respect to the housing 16 and is composed of a concave hole opening on a sliding face of the timing rotation body 12*b* which comes into slide contact with the rotor 18. 32 is a spring as a mechanical urging means which uirges the lock pin 30 in an engaging direction with the lock hole 31. The spring 32 is stored in the pin hole 29.

The lock hole 31 is connected to the oil passage of the hydraulic control system, a hydraulic oil is applied to the head of the lock pin from the oil passage when the internal combustion engine is in operation. When the applied hydraulic pressure to the lock pin 30 becomes lower than the urging force of the spring 32 in response to the operational condition of the internal combustion engine, the lock pin 30 is fitted into the lock hole 31 due to the urging force of the spring 32, the housing 16 and the rotor 18 are locked to rotate together. Alternatively, when the applied hydraulic pressure becomes larger than the urging force of the spring 32, the lock pin 30 is detached from the lock hole 31 by the applied hydraulic pressure and the locking is released.

Thus, the lock pin 30 locks the rotor 18 at a maximum advanced position with respect to the housing 16 by the fitting of the lock pin 30 into the lock hole 31 due to the action of the urgingtforce of the spring 32 urging the lock pin 30. The lock pin 30 is detached from the lock hole 31 by the action of the hydraulic control pressure (the applied hydraulic pressure) in a direction against the urging force of the spring 32, thereby to release the locking. The lock pin 30, the lock hole 31 and the spring 32 constitute a locking means for the rotor 18 with respect to the housing 16.

33 is an opening passage to the atmosphere (hereafter atmosphere opening passage) provided in the rotor 18. The atmosphere opening passage 33 opens the side storing the spring 32 in the pin hole 29 to the atmosphere. The atmosphere opening passage 33 also serves as an air hole and a drain passage.

Figure 8:
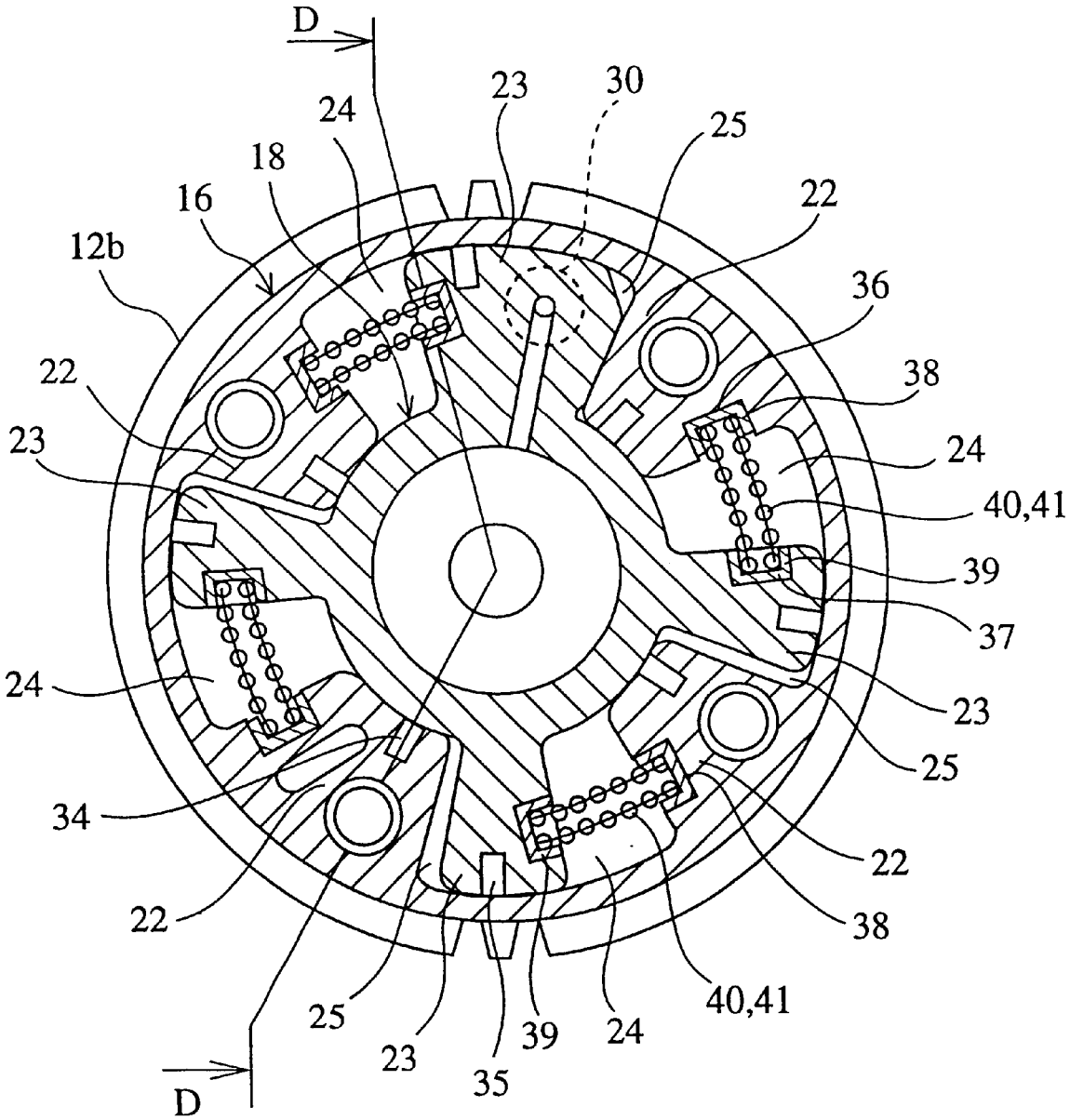
FIG. 8 is a cross sectional view along the line C—C of FIG. 7.
Figure 9:
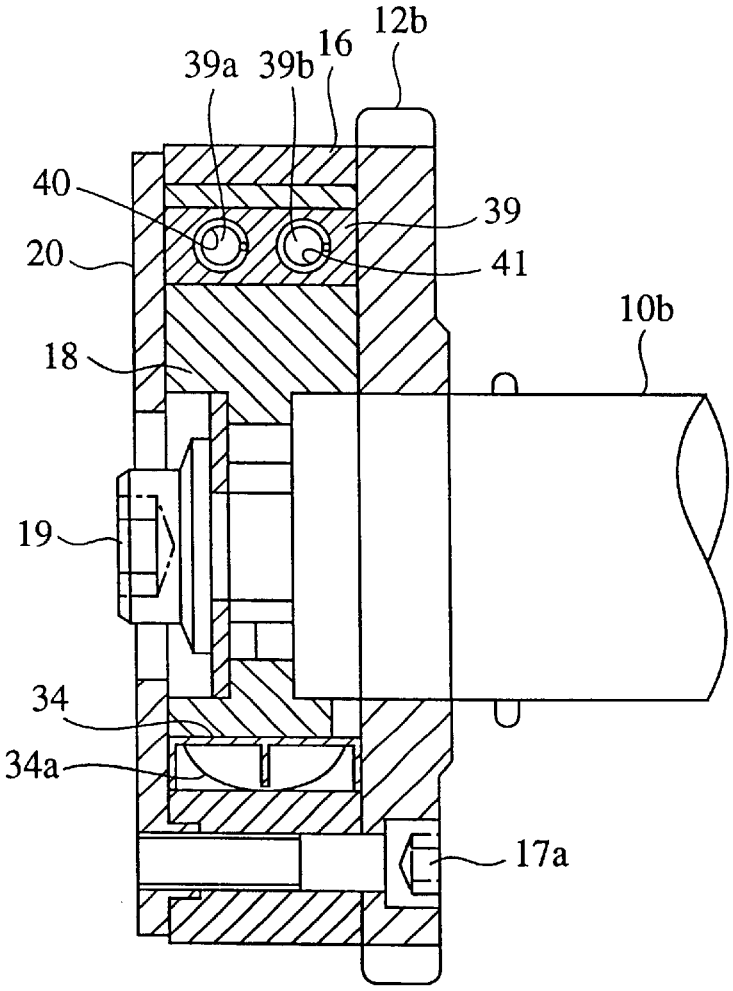
FIG. 9 is a cross sectional view along the line D—D of FIG. 8.

FIG. 8 is a cross sectional view along the line C—C of FIG. 7. FIG. 9 is a cross sectional view along the line D—D of FIG. 8. In the figures, reference numeral 34 denotes a tip seal provided on the tip of each shoe 22 of the housing 16 to be sidable in the radial direction. 34*a* is a back spring (refer to FIG. 7 and FIG. 9) which urges the tip seal 34 inta direction of sliding contact with an outer peripheral surface of the body portion of the rotor 18. 35 is a tip seal provided on the tip of each vane 18 of the rotor 18 to slide in the radial direction. The tip seal 35 has a back spring (not shown) in the same way as the tip seal 34 to the shoes 22 and the tip seal 35 is in slide contact with an inner peripheral surface of the housing 16 by the urging force of the back spring.

In FIG. 8, reference numeral 36 denotes a concave groove (hereafter shoe groove) provided on a wall surface of each shoe 22 situated on a side of the advancing hydraulic chamber 24. 37 is a concave groove (hereafter vane groove) provided on a wall surface of each vane 23 situated on the side of the advancing hydraulic chamber 24. The shoe grooves 36 and vane grooves 37 serve as a holder engagement section which engages with the holder members 38, 39 (described below) for retaining the spring. The shoe grooves 36 and vane grooves 37 are formed on the wall surface of each shoe 22 and each vane 23 and run the full axial length thereof. Thus, both ends of the vane groove 37 and the shoe groove 36 are opened on both end faces in the axial direction of each shoe 22 and each vane 23.

Reference numerals 38, 39 denote a pair of holder members for retaining the spring, which are fitted respectively into the shoe groove 36 and the vane groove 37. 40, 41 are coil springs (hereafter simply referred to as spring), both ends of which are fitted into the holder members 38, 39 and stored in each advancing hydraulic chamber 24. The springs 40, 41 are retained in a compressed state between the shoe 22 and vane 23 which define the advancing hydraulic chamber 24.

The springs 40, 41 serve as a rotor urging member which urges the rotor 18 toward the advancing direction with respect to the housing 16 by its elastic force.

Figure 10:
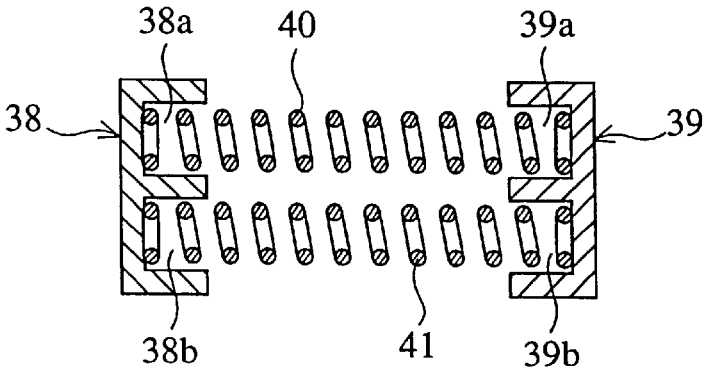
FIG. 10 is a cross sectional view showing a unit of the springs being a rotor urging member as shown in FIG. 8 and FIG. 9 and the holder members therefor.

FIG. 10 is a cross sectional view of the unit constituted by the springs 40, 41 as a rotor urging member and the holder members 38, 39 therefor in FIG. 8 and FIG. 9.

The holder members 38, 39 are fitted into the shoe groove 36 and the vane groove 37, and are integrally formed by a resinous material in a rectangular parallelepiped shape with approximately the same length as the axial length of the shoe groove 36 and the vane groove 37. The holder members 38, 39 each have two engagement holes 38*a*, 38*b* and 39*a*, 39*b* into which both ends of the springs 40, 41 are fitted The engagement holes 38*a*, 38*b* and 39*a*, 39*b* are formed by cylindrical holes.

Figure 11:
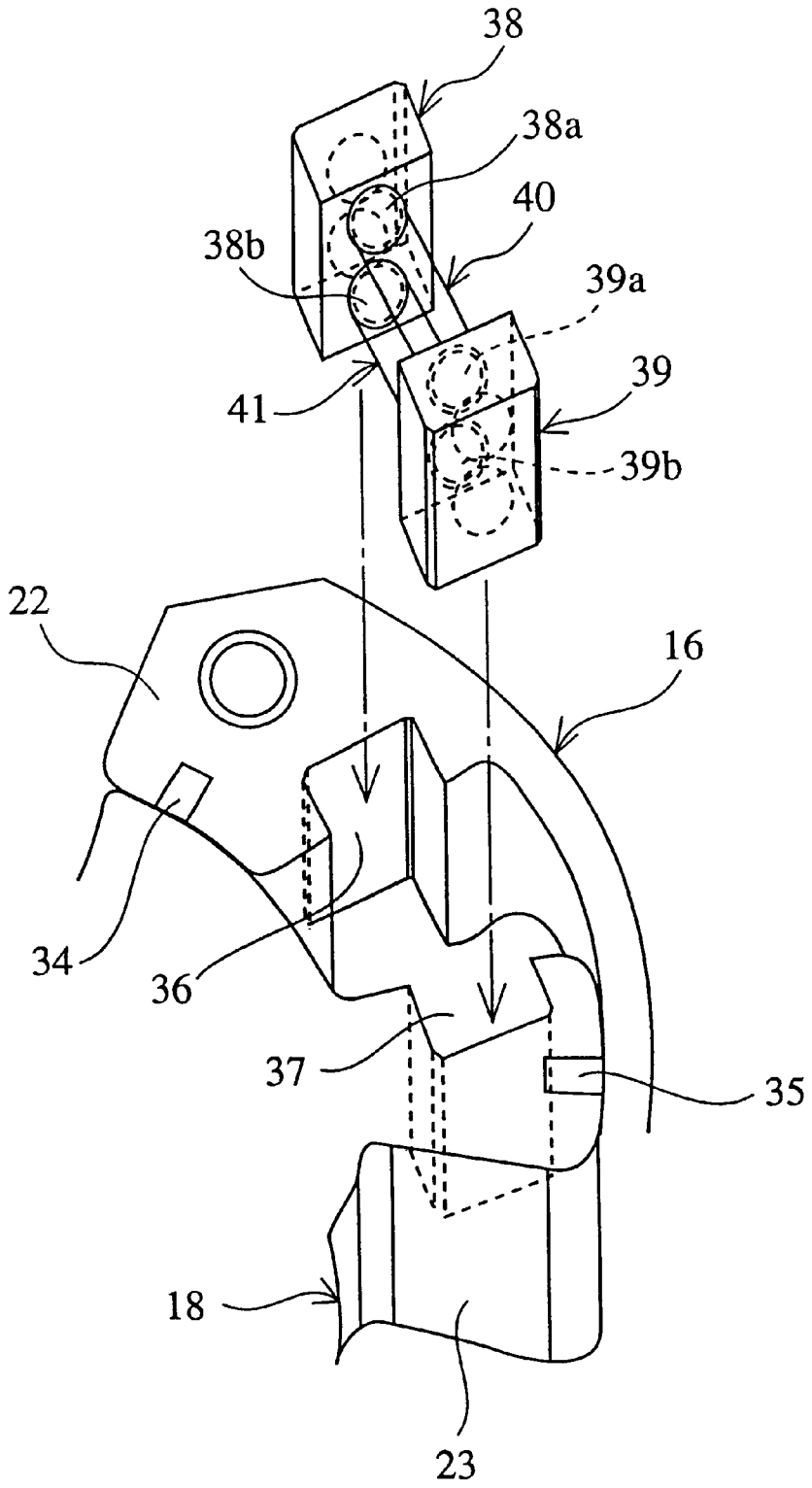
FIG. 11 is an exploded perspective view showing the components of the valve timing regulation device according to the first embodiment of the present invention.

The assembly process of the springs 40, 41 will be described below. FIG. 11 is a partial perspective view showing the assembly process of the springs 40, 41.

Firstly, an assembly unit comprising the right and left pair of holder members 38, 39 and the double springs 40, 41 is formed by fitting both ends of the springs 40, 41 being fittingly inserted into the engagement holes 38*a*, 38*b* and 39*a*, 39*b* of the pair of holder members 38, 39 respectively, the unit of the holder members 38, 39 and the springs 40, 41 is assembled.

Then, with the rotor 18 inserted into the housing 16, the holder members 38, 39 disposed at both ends of the springs 40, 41 are inserted into the shoe groove 36 and the vane groove 37 from one axial end thereof while compressing the springs 40, 41, the springs 40, 41 are arranged at a storage position in the advancing hydraulic chamber 24. In such a way, both ends of the springs 40, 41 are supported through the holder members 38, 39 on the wall portion of each shoe 22 and each vane 23 situated on a side of the advancing hydraulic chamber 24. At this point, the assembly of the springs 40, 41 is completed. After assembly, the valve timing regulation device is assembled by fixing a covering member 20 and a timing rotation body 12*b* to both axial ends of the housing 16 with a bolt 17*a* as shown in FIG. 7 and FIG. 9. The valve timing regulation device is attached to the camshaft 10*b* and the rotor 18 is fixed with an axial bolt 19 to the camshaft 10*b*. In this manner, the valve timing regulation device is mounted on the engine.

Next, the operation of the valve timing regulation device will be described below.

Figure 1:
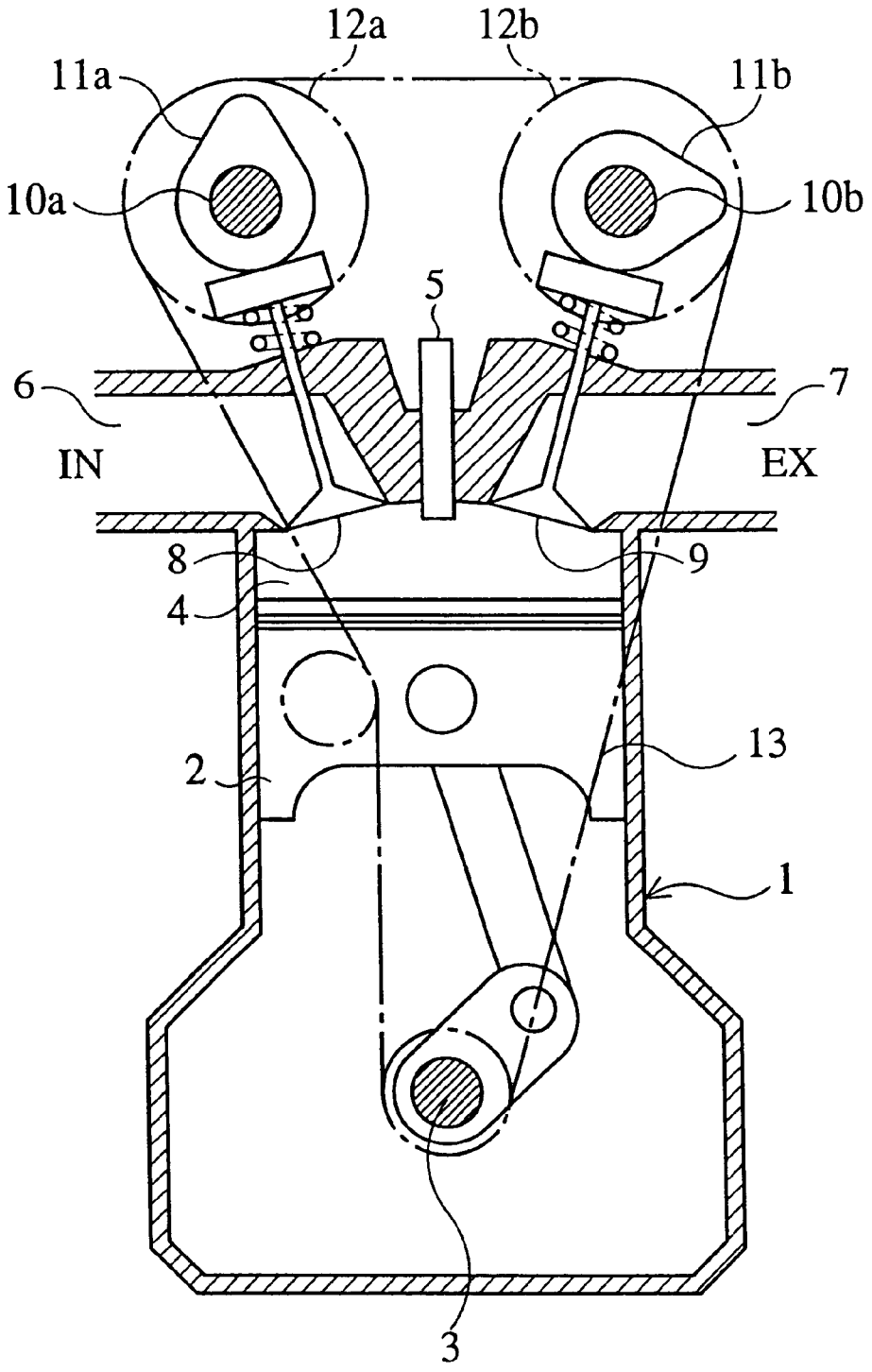
FIG. 1 is a schematic cross sectional view showing the structure of a general internal combustion engine.

During operation of the internal combustion engine, when a hydraulic pressure, which is supplied to the lock hole 31 as shown in FIG. 7 and is applied to the head of the lock pin 30, becomes larger than the urging force of the spring 32 applied to the lock pin 30, the lock pin 30 is detached from the lock hole 31 against the urging force of the spring 32. Thus, the lock between the timing rotation body 12*b* rotating together with the housing 16 and the rotor 18 is released, the housing 16 and the rotor 18 can rotate relative to one another. As a result, the opening and closing timing of the exhaust valve 9 as shown in FIG. 1 is automatically regulated by the relative rotation of the housing 16 and the rotor 18 in response to the operation condition of the internal combustion engine.

In such a state, namely, in a state that the lock between the rotor 18 and the housing 16 is released, when the internal combustion engine is stopped, a rotational reaction force in a retarding direction is generated to the camshaft 10*b*. However, the rotor 18 rotates toward an advancing direction by the elastic force of the springs 40, 41 which urge the rotor 18, rotating together with the camshaft 10*b*, in the opposite direction (advancing direction) to that of the rotational reactive force.

Therefore, the rotor 18 does not rotate in the retarding direction even when the internal combustion engine is stopped and the rotational reactive force is generated to the camshaft 10*b*. Namely, rotation of the rotor 18 up to a maximum advanced position is ensured by the elastic force of the springs 40, 41, the lock pin 30 becomes faced with the lock hole 31 at the maximum advanced position. As a result, the lock pin 30 is inserted into the lock hole 31 by the urging force of the rear spring 32, thereby to lock the rotor 18 and the housing 16.

As described above, according to the first embodiment of the present invention, both ends of each of the springs 40, 41, which urges the rotor 18 in the housing 16 toward an advancing direction, are supported through the holder members 38, 39 on the wall surfaces of the shoe 22 and vane 23. Thus, both ends of the springs 40, 41 do not undergo friction with the wall portion of the shoe 22 and the vane 23. As a result, the advantageous effect is obtained that frictional wear of the springs 40, 41 is prevented. Moreover, it is possible to arrange the springs 40, 41 in each advancing hydraulic chamber 24 by simply compressing the springs 40, 41. Thus, the assembly productivity of the springs 40, 41 is improved. Furthermore, since no torsion reactive force is generated in the springs 40, 41 during assembly, the vane 23 of the rotor 18 is not inclined by the torsion reactive force which thus improves the assembly accuracy of the springs.

Figure 2:
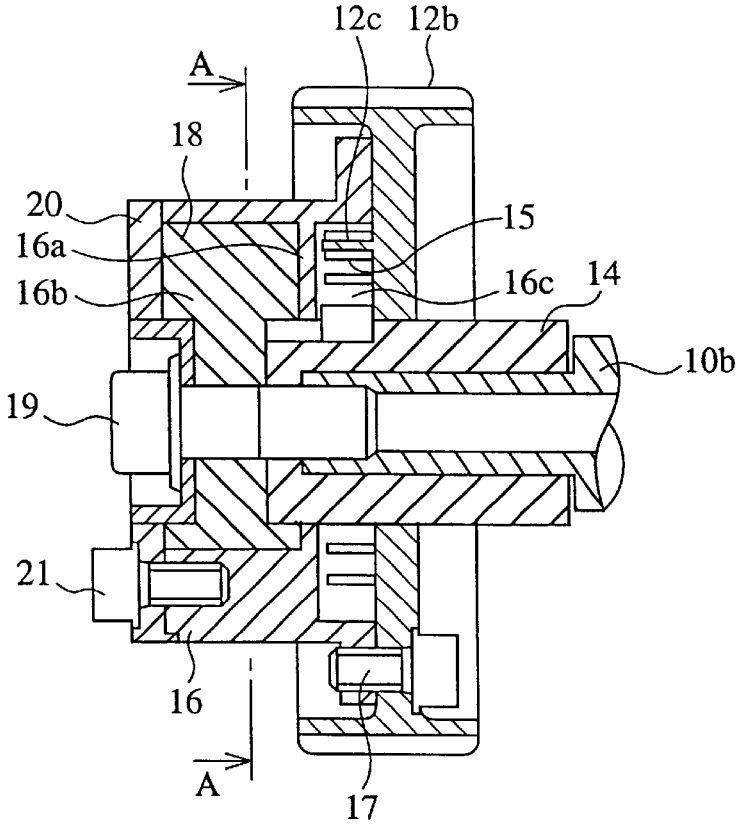
FIG.2 PRIOR ART
FIG. 2 is a cross sectional view along an axial direction of a first conventional valve timing regulation device.
Figure 3:
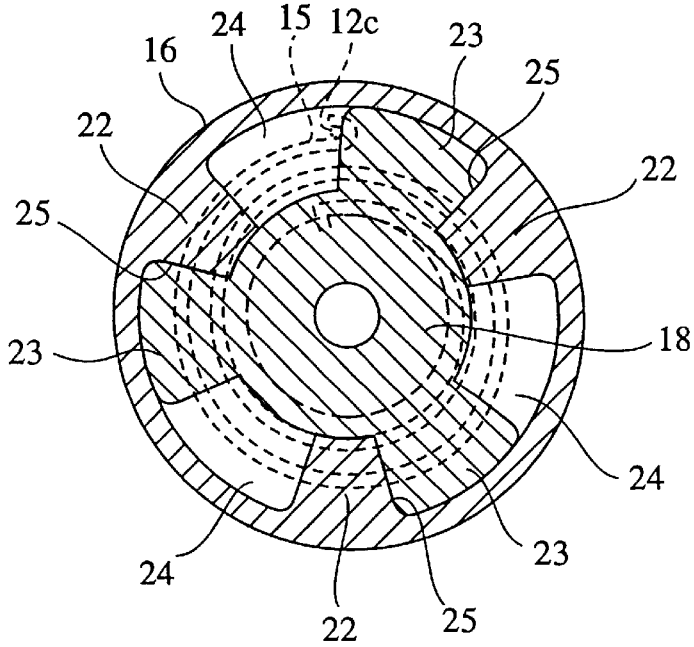
FIG.3 PRIOR ART
FIG. 3 is a cross sectional view along the line A—A of FIG. 2.
Figure 4:
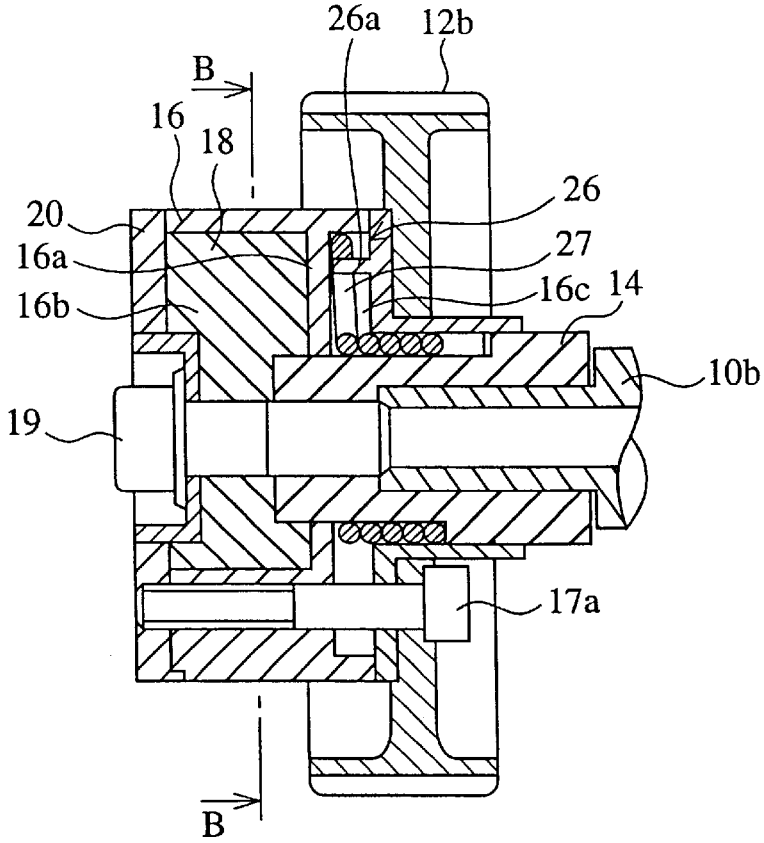
FIG.4 PRIOR ART
FIG. 4 is a cross sectional view along an axial direction of a second conventional valve timing regulation device.
Figure 5:
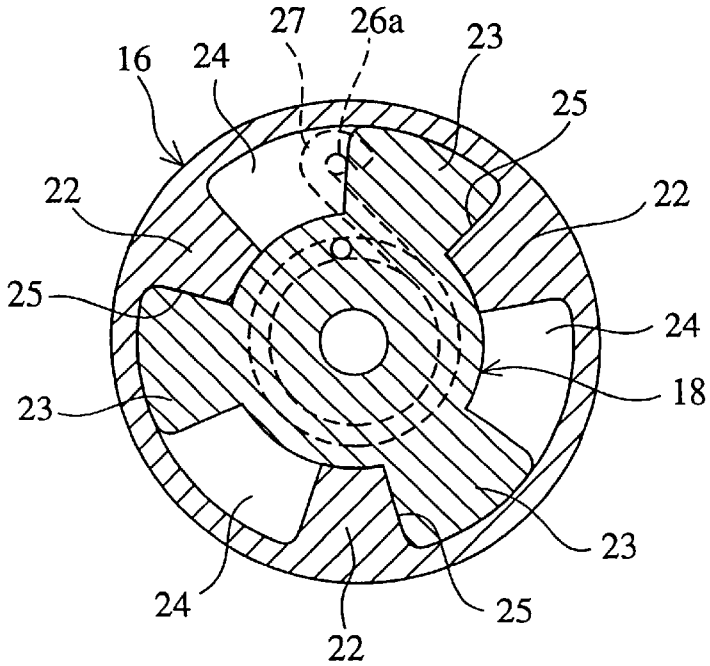
FIG.5 PRIOR ART
FIG. 5 is a cross sectional view along the line B—B of FIG. 4.
Figure 6:
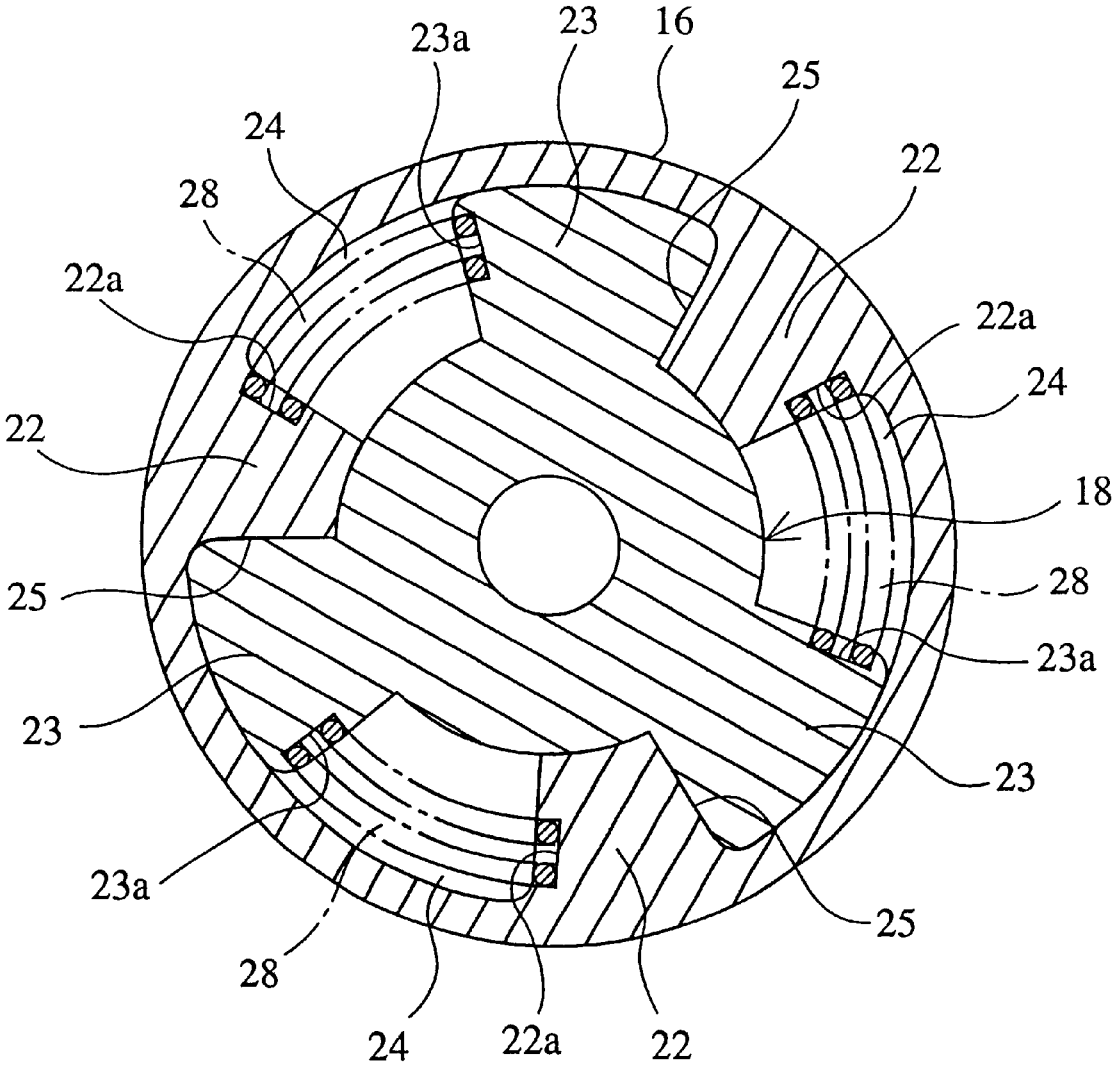
FIG.6 PRIOR ART
FIG. 6 is a cross sectional view along an axial direction of a third conventional valve timing regulation device.

Further, according to the first embodiment, the springs 40, 41 are stored in the advancing hydraulic chamber 24 as described above. Thus, in contradistinction to the first conventional example shown in FIG. 2 and the second conventional example shown in FIG. 4, there is no necessity to form a separate spring storage chamber 16*c* which is partitioned from the rotor storage chamber 16*b* by a partition 16*a* projecting from the inner periphery of the housing 16. Furthermore, the structure of the device can be simplified as the projection 12*c* as shown in FIG. 2 and the rear plate 26 as shown in FIG. 4 are no longer required. Thus, it is possible to reduce the costs and to downsize the valve timing regulation device.

In particular, in the first embodiment, a shoe groove 36 and a vane groove 37 are formed over the full axial length on the wall surfaces of the shoe 22 and the vane 23 which are situated on both sides of the advancing hydraulic chamber 24, and the holder members 38, 39 for the springs 40, 41 are engaged with the shoe groove 36 and the vane groove 37. Thus, it is possible to assemble the springs 40, 41 efficiently and simply by sliding insertion of the holder members 38, 39 attached on both ends of the springs 40, 41 into the shoe groove 36 and the vane groove 37 from its axial end portion.

Furthermore, in the first embodiment, the holder members 38, 39 are provided with engagement holes 38*a*, 38*b*, 39*a*, 39*b* each having a concave shaped cross section, into which the ends, of the springs 40, 41 are respectively fitted. Thus, by fittingly inserting both ends of the springs 40, 41 into the engagement holes 38*a*, 38*b*, 39*a*, 39*b* of the holder members 38, 39, the springs 40, 41 can be retained in parallel by the holder members 38, 39 situated on both sides thereof and thus formed into a unit. As a result, by the slide insertion of the holder members 38, 39 into the shoe groove 36 and the vane groove 37 from one axial end, it is possible to simply mount the two parallel springs 40, 41 in the engine. After assembly, the holder members 38, 39 are pressed into the shoe groove 36 and the vane groove 37 with the repulsive force of the springs 40, 41, both axial ends of the shoe groove 36 and the vane groove 37 are covered by the covering member 20 and the timing rotation body 12*b*. Therefore, the holder members 38, 39 can not be detached from the shoe groove 36 and the vane groove 37, it is possible to certainly and securely mount the two springs 40, 41 in parallel to each other at a fixed mounting position. As a result, assembly accuracy can be improved.

Furthermore, according to the first embodiment, since the holder members 38, 39 are formed from an integrated component of resinous material, it is possible to improve the productivity, thereby reducing the cost.

Embodiment 2

Figure 12:
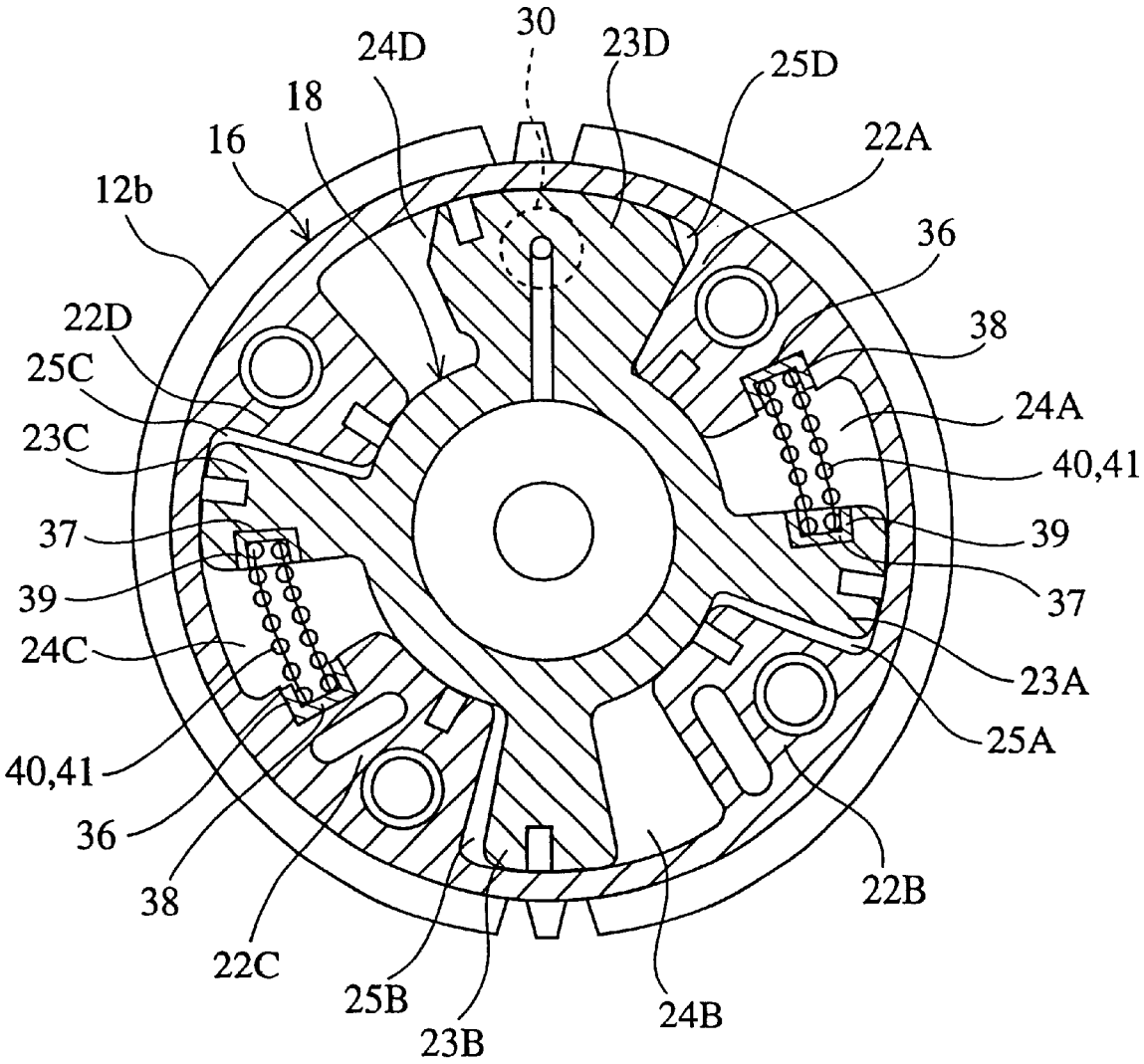
FIG. 12 is a cross sectional view in a radial direction of a valve timing regulation device according to a second embodiment of the present invention.

FIG. 12 is a cross sectional view in a radial direction of a valve timing regulation device according to a second embodiment of the present invention. Those components which are the same as or similar to components in FIG. 1 to FIG. 11 are designated by the same reference numerals and additional description will be omitted.

In FIG. 12, reference numerals 22A–22D denote an even number (4 in the figure) of shoes which are integrated with the housing 16 and project from an inner peripheral surface of the housing 16. 23A–23D denote an even number (the same number of shoes 22A–22D) of vanes which are integrated with the rotor 18 and project from an outer peripheral surface of the rotation body of the rotor 18. In the second embodiment, an even number (in the figure, there are four groups) of advancing hydraulic chambers 24A–24D and retarding hydraulic chambers 25A–25D are formed by the shoes 22A–22D and the vanes 23A–23D. Furthermore, the advancing hydraulic chambers 24A–24D are adapted so that a pair of advancing hydraulic chambers 24A, 24C are arranged in an axial symmetry position to each other with respect to an axis of the rotor 18 (the camshaft 10*b* in FIG.

7 and FIG. 9) and a unit of the springs 40, 41 and the holder members 38, 39 is attached only in the pair of the advancing hydraulic chambers 24A, 24C.

Thus, in this second embodiment, the shoe groove 36 and the vane groove 37 are formed only on the wall surfaces of the shoes 22A, 22C and vanes 23A, 23C which are situated on both sides of the advancing hydraulic chambers 24A, 24C disposed in the axial symmetry position.

That is to say, in the first embodiment, the unit of the springs 40, 41 and holder members 38, 39 is attached in each advancing hydraulic chamber 24. However, in the second embodiment, the unit of the springs 40, 41 and the holder members 38, 39 is attached only in al pair of advancing hydraulic chambers 24A, 24C which are disposed in an axial symmetry position with respect to the rotor 18. The holder members 38, 39 disposed on both ends of the springs 40, 41 are attached into the shoe groove 36 and vane groove 37 by sliding insertion from one axial end thereof.

Therefore, according to the second embodiment, since the units of the springs 40, 41 and the holder members 38, 39 are arranged only into the pair of advancing hydraulic chambers 24A, 24C which are disposed in the axial symmetry position with respect to a central axis of the rotor 18, it is possible to reduce the number of process steps for the shoe groove 36 and the vane groove 37. It is also possible to reduce the number of the springs 40, 41 and the holder members 38, 39 used and therefore to reduce the cost. Moreover, as described above, since two units of the springs 40, 41 and the holder members 38, 39 are disposed in the axial symmetry position with respect to the rotor 18, it is possible to mount the two spring units in a well-balanced manner. As a result, it is possible to suppress inclination and entanglement of the rotor 18 in the housing 16.

Embodiment 3

Figure 13:
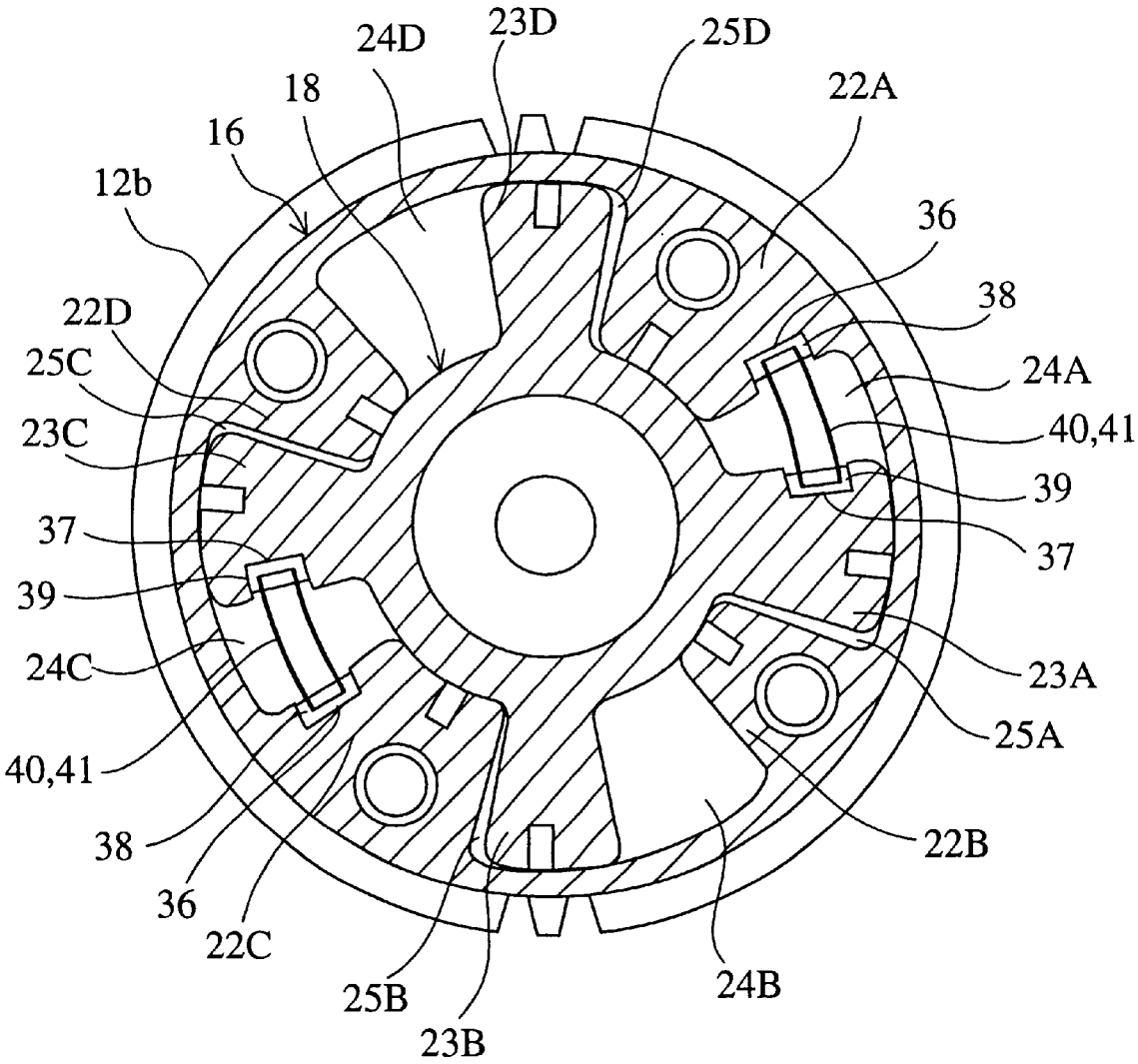
FIG. 13 is a cross sectional view in a radial direction of a valve timing regulation device according to a third embodiment of the present invention.

FIG. 13 is a cross sectional view in a radial direction of a valve timing regulation device according to a third embodiment of the present invention. Those components which are the same as or similar to components in FIG. 12 are designated by the same reference numerals and additional description will be omitted.

In this third embodiment, the unit of the holder members 38, 39 and the springs 40, 41 is arranged and assembled only in the advancing hydraulic chambers 24A, 24C which are situated in an axial symmetry position about the rotor 18 in the same manner as the second embodiment. However, in the third embodiment, the respective peripheral length of the shoes 22A, 22C and the vanes 23A, 23C forming the respective a dancing hydraulic chambers 24A, 24C is set so that it is longer than the respective peripheral length of the shoes 22B, 22D and vanes 23B, 23D forming the respective advancing hydraulic chambers 24B, 24D in which the unto the holder members 38, 39 and the springs 40, 41 is not mounted.

Namely, in the third embodiment, the respective peripheral length of the shoes 22A, 22C and vanes 23A, 23C forming the axial symmetry advancing hydraulic chambers 24A, 24C, in which the unit of the holder members 38, 39 and the springs 40, 41 is mounted, is set so that it is longer than the respective peripheral length of the shoes 22B, 22D and vanes 23B, 23D forming other advancing hydraulic chambers 24B, 24D in which the unit of the holder members 38, 39 and the springs 40, 41 is not mounted. Thus, even if the shoe groove 36 and the vane groove 37 are formed in the shoes 22A, 22C and the vane 23A, 23C in order to insert the holder members 38, 39, it is possible to maintain a sufficient strength in the shoes 22A, 22C and the vane 23A, 28C.

Embodiment 4

Figure 14:
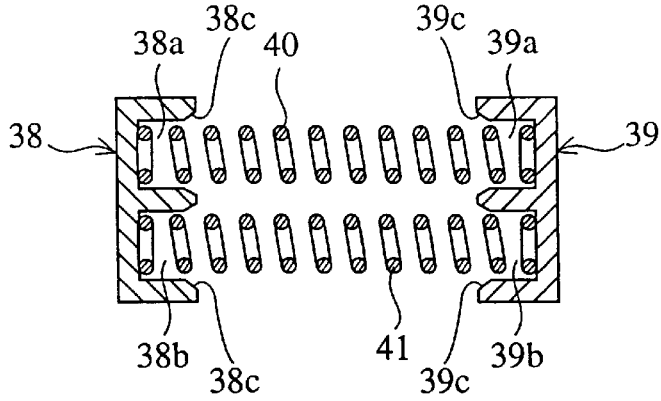
FIG. 14 is a cross sectional view showing a unit of the springs for urging a rotor and the holder members according to a fourth embodiment of the present invention.

FIG. 14 is a cross sectional view of the unit constituted by the holder members and the springs, which acts as a rotor urging member, according to a fourth embodiment of the present invention. Those components which are the same as or similar to those in FIG. 10 are denoted by the same reference numerals and additional description will be omitted. In the figure, reference numerals 38*c*, 39*c* denote tapering mouths formed by beveling the mouth edges of the engagement holes 38*a*, 38*b* and 39*a*, 39*b* of the night and left holder members 38, 39.

Thus, in the fourth embodiment, since the mouth edges of the engagement holes 38*a*, 38*b*, 39*a*, 39*b* of the holder members 38, 39 are formed as tapering mouths 38*c*, 39*c*, it is possible to fit both ends of the springs 40, 41 easily into the engagement holes 38*a*, 38*b*, 39*a*, 39*b* of the holder members 38, 39. As a result, it is possible to easily assemble a unit of the pair of holder members 38, 39 and the two springs 40, 41.

Embodiment 5

Figure 15:
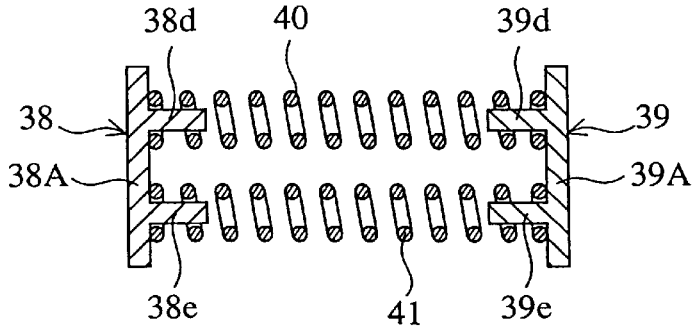
FIG. 15 is a cross sectional view showing a unit of the springs for urging a rotor and the holder members therefor according to a fifth embodiment of the present invention.

FIG. 15 is a cross sectional view of the unit constituted by the springs and the holder members as a rotor urging member according to a fifth embodiment of the present invention. In the figure, reference numerals 38A, 39A denote a face plate portion of each holder member 38, 39. 38*d*, 38*e* and 39*d*, 39*e* are engagement projections for engaging the spring which are integrally formed on one face of each face plate portion 38A, 39A and project therefrom.

That is to say, in the first embodiment to the fourth embodiment, the holder members 38, 39 are provided with the engagement holes 38*a*, 38*b*, 39*a*, 39*b* which retain both ends of the springs 40, 41, each of the holder members 38, 39 is integrally formed by a resinous material, and both ends of the springs 40, 41 are supported by using the holder members 38, 39. However, in the fifth embodiment, the holder members 38, 39 are provided with the engagement projections 38*d*, 38*e*, 39*d*, 39*e* instead of the engagement holes 38*a*, 38*b*, 39*a*, 39*b*, each of the holder members 38, 39 is integrally formed by a resinous material, and both ends of the springs 40, 41 are supported by use of the holder members 38, 39.

Thus, according to the fifth embodiment, it is possible to easily assemble a unit of the holder members 38, 39 and the springs 40, 41 by engaging both ends of the springs 40, 41 with the engagement projections 38*d*, 38*e*, 39*d*, 39*e* of the holder members 38, 39 and to attach the unit in the shoe groove 36 and the vane groove 37. Namely, it is possible to obtain the same advantageous effects as the first to fourth embodiments.

Embodiment 6

In the first to fifth embodiments, each holder member 38, 39 which has engagement holes 38*a*, 38*b*, 39*a*, 39*b* or engagement projections 38*d*, 38*e*, 39*d*, 39*e* is integrally formed by a resinous material. However, in this sixth embodiment, each holder member 38, 39 is integrally formed by a hard resilient material such as a hard rubber or the like.

Thus, in the sixth embodiment, since the holder members 38, 39 are formed by the hard resilient material, it is possible to display a buffering function of the springs 40, 41 by the holder members 38, 39.

Embodiment 7

Figure 16:
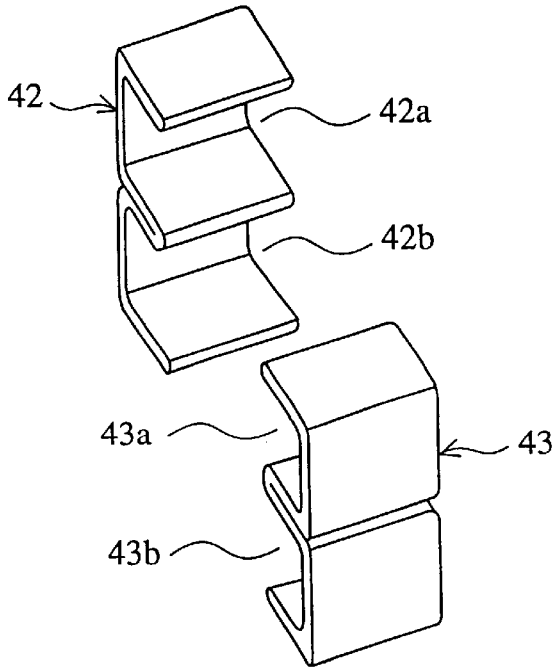
FIG. 16 is a perspective view showing a pair of holder members according to a seventh embodiment of the present invention.

FIG. 16 is a perspective view showing a pair of holder members according to a seventh embodiment of the present invention. In the figure, reference numerals 42, 43 denote a pair of holder members formed by a pressed sheet metal. Each holder member 42, 43 is integrally formed in a shape with a pair of concavities 42*a,* 42*b* and 43*a,* 43*b* which are adjacent to each other and fitted with both ends of the springs 40, 41 as shown in the first to fifth embodiments.

Namely, in the seventh embodiment, each holder member 42, 43 is integrally formed from a sheet metal in a shape with a pair of concavities 42*a,* 42*b* and 43*a,* 43*b* which are disposed adjacent to each other and into which the ends of the springs 40, 41 is respectively fitted. Thus, it is possible to form the holder members 42, 43 easily by only as pressing process of the sheet metal in a parallel concave shape. As a result, it is possible to improve the productivity and to maintain a sufficient mechanical strength of the holder members 42, 43.

Embodiment 8

In this eighth embodiment, the structure of holder members is the same as that of the holder members as shown in the above first to fifth embodiments, that is to say, the holder members 38, 39 have engagement holes 38*a,* 38*b,* 39*a,* 39*b* or engagement projections 38*d,* 38*e,* 39*d,* 39*e.* However, in this eighth embodiment, each holder member 38, 39 is integrally formed by a molding process such as metal casting or forging.

A valve timing regulation device as above allows mass production of the holder members 38, 39 with a sufficient, mechanical strength by a molding process on a metallic material. Thus, the productivity can be improved, thereby reducing the cost. Furthermore, it is possible to provide the holder members 38, 39 and the springs 40, 41 as a unit by simply fitting both ends of the springs 40, 41 with the engagement holes 38*a,* 38*b,* 39*a,* 39*b* or engagement projections 38*d,* 38*e,* 39*d,* 39*e.*

Embodiment 9

Figure 17:
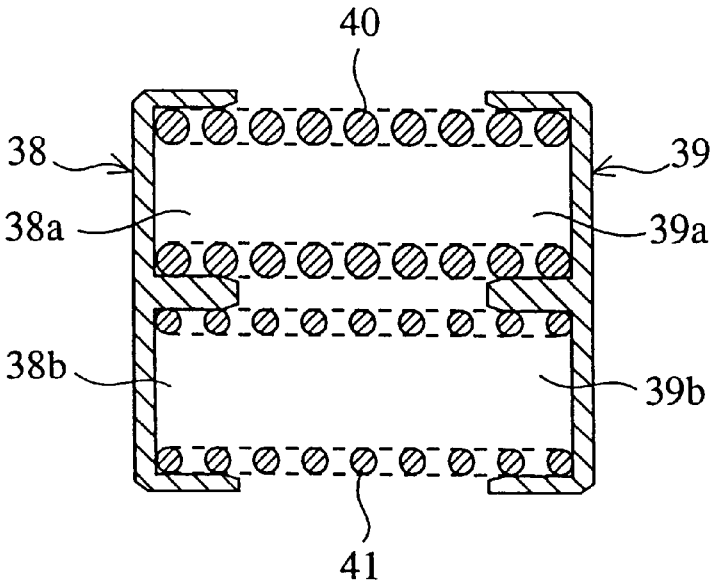
FIG. 17 is a cross sectional view showing a unit of the springs for urging a rotor and the holder members therefor according to a ninth embodiment of the present invention.

FIG. 17 is a cross sectional view showing a unit of the springs as a rotor urging member and the holder members therefor according to a ninth embodiment of the present invention. Those components which are the same as or similar to those in FIG. 10 and FIG. 14 are denoted by the same reference numerals and additional description will be omitted.

In this ninth embodiment, although a pair of the holder members 38, 39 and the two springs 40, 41 are provided as a unit in the same manner as the above first to third embodiments, the springs 40, 41 are adapted so that one spring 40 is formed by a large diameter coil wire and the other spring 41 is formed by a small diameter coil wire. Namely, the coil wires of the springs 40, 41 have different sizes in diameter. However, the springs 40, 41 have the same length.

According to the ninth embodiment, since the springs 40, 41 disposed in parallel and supported at both ends by the pair of holder members 38, 39, have the different coil wire in diameter from each other, a coil pitch (wire to wire distance of the coil) in one spring 40 is also different from that in the other spring 41. Thus, the springs 40, 41 do not become mutually entangled even in the unlikely event that a bending compression is applied to the parallel springs 40, 41 which are provided as a unit with the holder members 38, 39. As a result, it is possible to suppress inclination or meshing of the rotor 18 caused as a result of the entanglement, thereby to further improve assembly accuracy.

Embodiment 10

Figure 18:
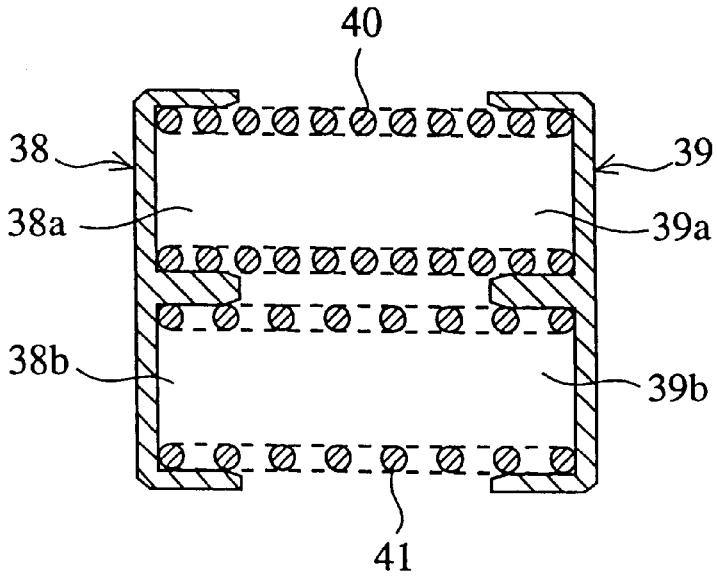
FIG. 18 is a cross sectional view showing a unit of the springs for urging a rotor and the holder members according to a tenth embodiment of the present invention.

FIG. 18 is a cross sectional view showing a unit of the springs for urging a rotor and the holder members according to a tenth embodiment of the present invention. Those components which are the same as or similar to those in FIG. 17 are denoted by the same reference numerals and additional description will be omitted.

In this tenth embodiment, double springs 40, 41 are provided with the same length in a parallel unit with the pair of holder members 38, 39 in the same manner as the first to third embodiments above, and the number of turns in one spring 40 is greater than that in the other spring 41. Namely, the springs 40, 41 are different in the number of turns from each other.

According to the tenth embodiment, since the coil pitch (wire to wire distance) in the respective springs 40, 41 is different from each other due to the fact that the number of turns in the respective springs 40, 41, which are disposed in parallel and supported at both ends by the pair of holder members 38, 39, is different from each other, the springs 40, 41 do not become mutually entangled even in the unlikely event that a bending compression is applied to the parallel springs 40, 41 provided as a unit with the holder members 38, 39. Thus, it is possible to suppress inclination or meshing of the rotor 18 generated as a result of the entanglement, thereby to further improve assembly accuracy.

Embodiment 11

Figure 19:
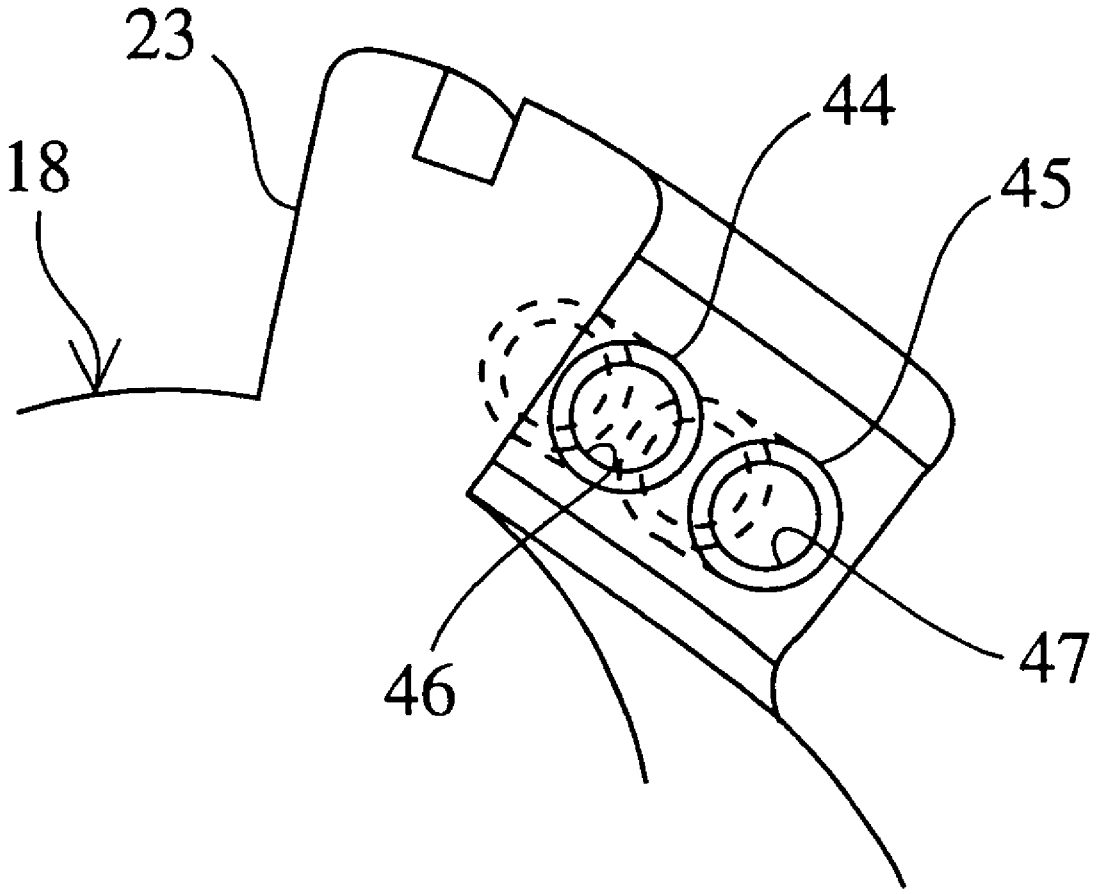
FIG. 19 is a partial perspective view showing the rotor of a valve timing regulation device according to an eleventh embodiment of the present invention.

FIG. 19 is a partial perspective view showing the rotor of a valve timing regulation device according to an eleventh embodiment of the present invention. Those components which are the same as or similar to those in FIG. 8, FIG. 11 and FIG. 12 are denoted by the same reference numerals and additional description will be omitted.

In the figure, reference numerals 44, 45 denote holes for engaging the holder members, which are opened on a wall surface of the vane 23 situated on a side of the advancing hydraulic chambers 24. 46, 47 are cylindrical holder members which are engaged with the holes 44, 45. The holder members 46, 47 are formed from a resilient material such as hard rubber or resinous material and fitted with one end of the springs 40, 41 as described with reference to the first to tenth embodiments. Holes which open toward the advancing hydraulic chambers 24 are also provided on the side wall surface of the shoe 22 of the housing 16 which is situated on a side of the advancing hydraulic chambers 24 storing the springs 40, 41 as shown in FIG. 8, FIG. 11 and FIG. 12. The holder members 46, 47 are engaged with the holes provided on the wall surface of the shoe 22, and the other end of the springs 40, 41 is engaged with the holder members.

As shown above, according to the eleventh embodiment, holes 44, 45 are provided on the respective wall surfaces of the shoe 22 and the vane 23 situated on both sides of the advancing hydraulic chamber storing the springs 40, 41, the cylindrical holder members 46, 47 are engaged with the holes 44, 45. Thus, it is possible to perform simplelassembly of the springs 40, 41 by merely fitting both ends of the springs 40, 41 into the holder members 46, 47 of the shoe 22 and vane 23. As a result, assembly productivity can be improved.

Embodiment 12

Figure 20:
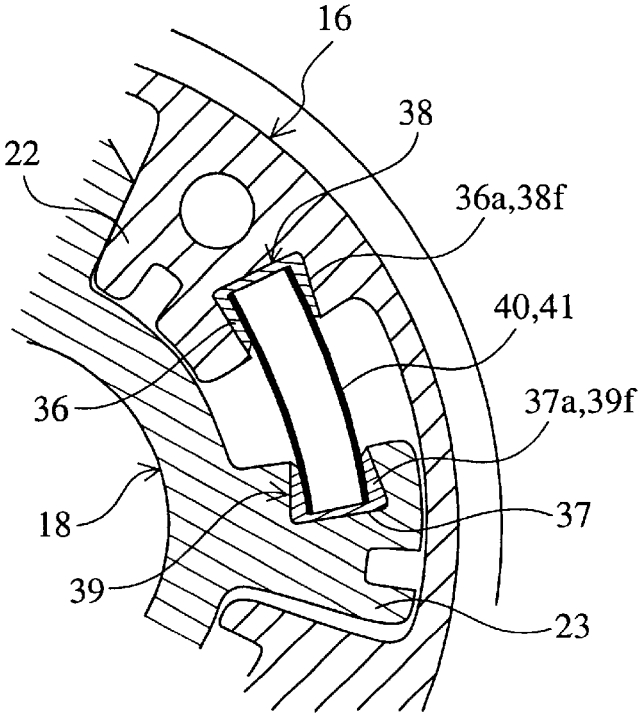
FIG. 20 is a cross sectional view showing the components of a valve timing regulation device according to a twelfth embodiment of the present invention.
Figure 21:
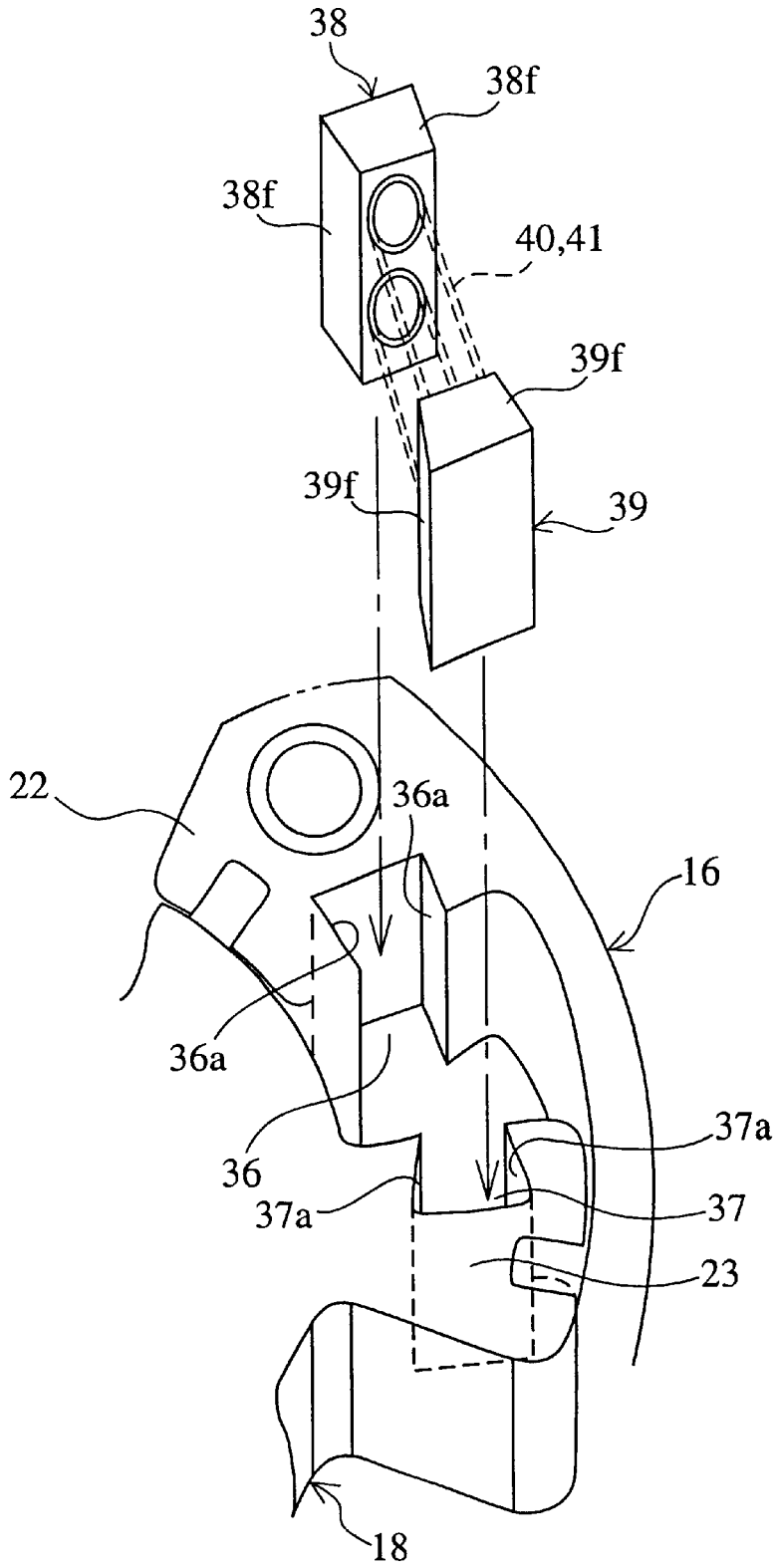
FIG. 21 is an exploded perspective view of FIG. 20.

FIG. 20 is a cross sectional view showing the components of a valve timing regulation device according to a twelfth embodiment of the present invention. FIG. 21 is an exploded perspective view of FIG. 20. Those components which are the same as or similar to those in FIG. 8 to FIG. 14, FIG. 17 and FIG. 18 are denoted by the same reference numerals and additional description will be omitted. In the figures, reference numeral 36*a* denotes a tapering face which is formed on both inner wall surfaces of the concave shoe groove (holder engagement groove) 36. The taper face 36*a* is formed so that the groove width of the shoe groove 36 is gradually narrowed towards the open end. 37*a* is a tapering face formed on both inner wall surfaces of the concave vane groove (holder engagement groove) 37. The tapering face 37*a* is formed so that the groove width of the vane groove 37 is gradually narrowed towards the open end. 38*f*, 39*f* are tapering surfaces which are formed respectively on both wall surfaces of the holder members 38, 39. The holder members 38, 39 are formed in a reversed wedge shape by the tapering faces 38*f*, 39*f*. The tapering faces 36*a*, 37*a* of the shoe groove 36 and the vane groove 37 are formed with approximately the same tapering angle as the tapering faces 38*f*, 39*f* of the holder member 38, 39. Thus, the tapering faces 36*a*, 37*a* of the shoe groove 36 and the vane groove 37 is adapted to fit with the tapering face 38*f*, 39*f* of the holder member 38, 39 when inserting the holder member 38, 39 into the shoe groove 36 and the vane groove 37.

Since the assembly process of the springs 40, 41 with respect to the twelfth embodiment is the same as that described with respect to the first embodiment above, further description will be omitted. However, in this twelfth embodiment, the holder members 36, 37 are wedged in the shoe groove 36 and the vane groove 37 by alignment of the tapering faces 38*f*, 39*f* of the holder members 38, 39 with the tapering faces 36*a*, 37*a* of the shoe groove 36 and the vane groove 37 when the holder members 38, 39 united with the springs 40, 41 are respectively inserted,from one axial end into the shoe groove 36 and the vane groove 37. As a result, detachment from the open end of the concave grooves in a rotation direction of the device is no longer possible.

As described above, according to the twelfth embodiment, it is possible to simplify the structure of the holder detachment prevention means by merely forming the tapering faces 36*a*, 37*a*, and 38*f*, 39*f* on both wall surfaces of the holder members 38, 39 and both inner wall surfaces of the shoe concave groove 36 and the vane concave groove 37 serving as the holder engagement grooves. Therefore, even if vibration or an unlikely unforeseen event occurs, detachment of the holder members 38, 39 in a rotation direction of the device is not possible and accurate operation of the device is ensured, due to the alignment of the tapering faces 36*a*, 37*a* with the tapering faces 38*f*, 39*f*.

Embodiment 13

Figure 22:
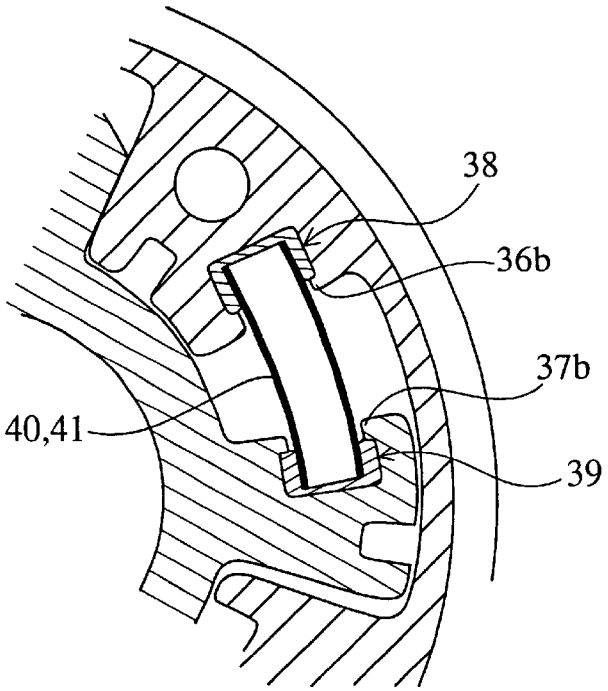
FIG. 22 is a cross sectional view showing the components of a valve timing regulation device according to a thirteenth embodiment of the present invention.

FIG. 22 is a cross sectional view showing the components of a valve timing regulation device according to a thirteenth embodiment of the present invention. Those components which are the same as or similar to those in FIG. 8 to FIG. 14, FIG. 17 and FIG. 18 are denoted by the same reference numerals and additional description will be omitted. In the figure, reference numerals 36*b* and 37*b* denote catches for preventing detachment of the holder members which are provided on the respective open ends of the shoe groove 36 and the vane groove 37 serving as the holder engagement grooves. The catches 36*b*, 37*b* project from the inner wall surfaces of the shoe groove 36 and the vane groove 37 inwardly to narrow the groove width and are integrally formed in the respective open ends of the shoe groove 36 and the vane groove 37, and thus serve as a holder detachment prevention means.

As described above, according to the thirteenth embodiment, it is possible to easily form a holder detachment prevention means by merely forming the catches 36*b*, 37*b* for the holder members 38, 39 integrally in the respective open ends of the shoe groove 36 and the vane groove 37 serving as the holder engagement grooves. Therefore, even if vibration or an unlikely unforeseen event occurs, detachment of the holder members 38, 39 from the shoe groove 36 and the vane groove 37 in a rotation direction of the device is not possible and accurate operation of the device can be ensured due to the catches 36*b*, 37*b*.

Embodiment 14

Figure 23:
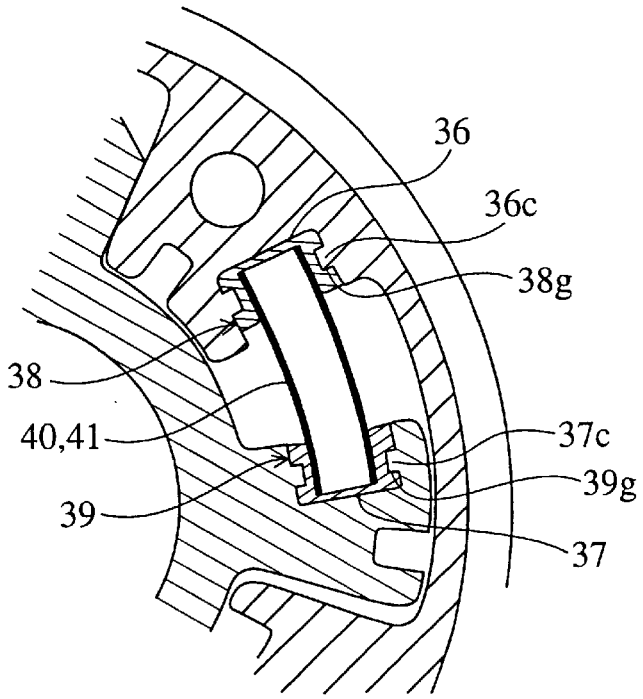
FIG. 23 is a cross sectional view showing the components of a valve timing regulation device according to a fourteenth embodiment of the present invention.

FIG. 23 is a cross sectional view showing the components of a valve timing regulation device according to a fourteenth embodiment of the present invention. Those components which are the same as or similar to those in FIG. 8 to FIG. 14, FIG. 17 and FIG. 18 are denoted by the same reference numerals and additional description will be omitted. In the figure, reference numeral 36*c* denotes engagement protrusions which are formed on both inner wall surfaces of the shoe groove (holder engagement groove) 36 to project therefrom and extend along an axial direction. The engagement protrusions 36*c* are formed integrally with the inner wall surfaces of the shoe groove 36. 37*c* denotes engagement protrusions which are formed on both inner wall surfaces of the vane groove (holder engagement groove) 37 to project therefrom and extend along the axial direction. The engagement protrusions 37*c* are formed integrally with the inner wall surfaces of the vane groove 37. 38*g*, 39*g* are engagement concavities which are integrally formed on both outer wall surfaces of the holder members 38, 39 and extend along the axial direction. The engagement concavities 38*g*, 39*g* are adapted to slidingly engage with the engagement projections 36*c*, 37*c* when the holder members 38, 39 are inserted from one axial end of the shoe groove 36 and the vane groove 37 thereinto. Thus, the engagement protrusions 36*c*, 37*c* and the engagement concavities 38*g*, 39*g* have a function as a holder detachment prevention means which prevents detachment of the holder members 38, 39, inserted into the shoe groove 36 and the vane groove 37, in a rotation direction of the device.

In this fourteenth embodiment, the engagement protrusions 36*c*, 37*c* are integrally informed on both inner wall surfaces of the shoe groove 36 and the vane groove 37, the engagement concavities 38*g*, 39*g* are integrally formed on both outer wall surfaces of the holder members 38, 39. However, the reverse arrangement in which the engagement concavities 38*g*, 39*g* are integrally formed on both inner wall surfaces of the shoe groove 36 and the vane groove 37 and the engagement protrusions 36*c*, 37*c* are integrally formed on both outer wall surfaces of the holder members 38, 39 is also possible and the same function is realized in either arrangement.

As described above, according to the fourteenth embodiment, it is possible to easily form a holder detachment prevention means by merely forming the engagement protrusions 36*c*, 37*c* on one of the shoe and vane grooves 36, 37 serving as the holder engagement grooves and the holder members 38, 39, and forming the engagement concavity 38*g*, 39*g* on the other of the shoe and vane grooves 36, 37 and the holder members 38, 39. Therefore, even if vibration or an unlikely unforeseen event occurs, detachment of the holder members 38, 39 from the shoe groove 36 and the vane groove 37 in a rotation direction of the device is not possible and accurate operation of the device can be ensured due to the engagement of the engagement protrusions 36*c*, 37*c* with the engagement concavities 38*g*, 39*g*.

Embodiment 15

Figure 24:
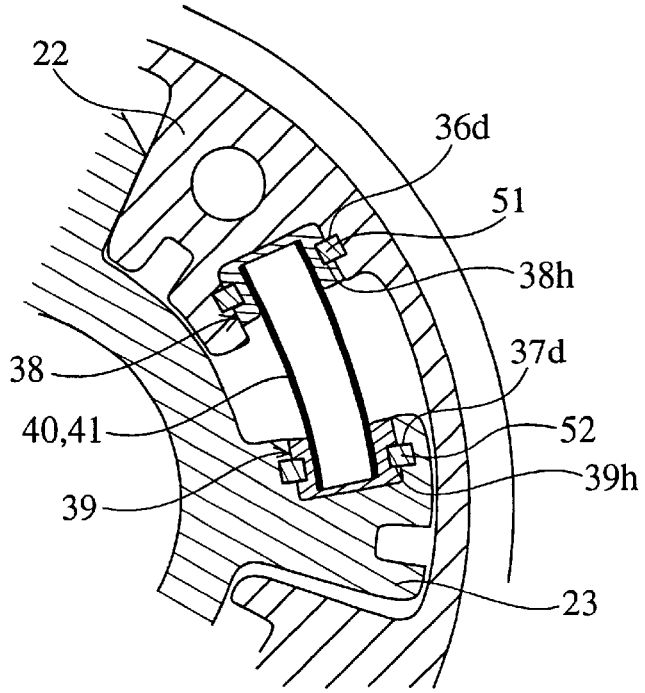
FIG. 24 is a cross sectional view showing the components of a valve timing regulation device according to a fifteenth embodiment of the present invention.

FIG. 24 is a cross sectional view showing the components of a valve timing regulation device according to a fifteenth embodiment of the present invention. Those components which are the same as or similar to those in FIG. 8 to FIG. 14, FIG. 17 and FIG. 18 are denoted by the same reference numerals and additional description will be omitted. In the figure, reference numeral 36*d* denotes key grooves (hereafter shoe key groove) each having a concave shape in cross section which is formed along an axial direction on both inner wall surfaces of the shoe groove 36. 37*d* denotes key grooves (hereafter vane key groove) each having a concave shape in cross section which is formed along an axial direction on both inner wall surfaces of the vane groove 37. 38*h*, 39*h* denote key grooves (hereafter holder key grooves) each having a concave shape in cross section which are formed on both outer wall surfaces of the holder members 38, 39. 51 is a key member which is inserted into the shoe key groove 36*d* and the holder key groove 38*h*. 52 is a key member which is inserted into the vane key groove 37*d* and the holder key groove 39*h*.

Next, the assembly process of the springs 40, 41 in the fifteenth embodiment will be described below.

Firstly, the holder members 38, 39 united with the springs 40, 41 are inserted from respective axial ends into the shoe groove 36 and the vane groove 37. At this time, the holder members 38, 39 are respectively pressed on the groove base of the shoe groove 36 and the vane groove 37 by the repulsive force of the springs 40, 41. Thus, the shoe key groove 36*d* and the vane key groove 37*d* are aligned with the holder key grooves 38*h*, 39*h* respectively. As a result, the holder members 38, 39 are wedged in the shoe groove 36 and the vane groove 37 by inserting the key members 51, 52 from the respective axial ends into spaces defined by the mutually aligned shoe key grooves 36*d* and holder key grooves 38*h* and into spaces defined by the mutually aligned vane key grooves 37*d* and holder key grooves 39*h*.

As described above, according to the fifteenth embodiment, the key grooves 36*d*, 37*d*, 38*h*, 39*h* are formed in both of the holder members 38, 39 and the shoe and vane grooves 36, 37 which serve as the holder engagement grooves, the key members 51, 52 are inserted from the respective axial ends into the key grooves 36*d*, 37*d*, 38*h*, 39*h*. Thus, it is possible to ensure fixation of the holder members 38, 39 into the shoe and vane grooves 36, 37 by the insertion of the key members 51, 52. Therefore, even if vibration or an unlikely unforeseen event occurs, detachment of the holder members 38, 39 in a rotation direction of the device is not possible and accurate operation of the device can be ensured.

Embodiment 16

The holder members 38, 39 in any of the twelfth to fifteenth embodiments may be formed integrally by a resilient material such as hard rubber or resinous material, or by a molding process such as casting or forging of a metallic material. In any of the above situations, the same advantageous effect can be obtained.

Industrial Applicability

As shown above, according to the present invention, a valve timing regulation device is adapted to support a rotor urging member, which urges a rotor towards a fixed lock position in a housing, through a holder member on the respective wall surfaces of a vane of the rotor and a shoe of the housing. Thus, both ends of the rotor urging member can be prevented from undergoing wear due to friction with wall portions of the shoe and the vane. Furthermore, when a plurality of rotor urging members are mounted into the same hydraulic chamber, it is possible to assemble the rotor urging members as a unit with the holder members and thus to improve the productivity.

What is claimed is:

1. A valve timing regulation device, including:

a camshaft which drives opening and closing of a valve in an internal combustion engine;

a housing having a plurality of shoes on an inner peripheral face, said housing being arranged to rotate freely on the camshaft and rotated with an output of the internal combustion engine;

a rotor having a plurality of vanes which define a retarding hydraulic chamber and an advancing hydraulic chamber in cooperation with both wall surfaces of each shoe orientated to a circumferential direction, said rotor being stored in the housing to rotate relative to the housing and coupled to the camshaft; and a lock means which is operated by a mechanical urging force and restricts the relative rotation of the rotor and the housing, said lock means releasing the restriction by operation of a hydraulic control pressure in a direction against the mechanical urging force, said valve timing regulation device comprising:

a rotor urging member disposed between the wall surfaces of the shoes and the vanes orientated to the circumferential direction for urging the rotor in a rotational direction towards a fixed lock position with respect to the housing; and, a pair of holder members mounted on the wall surfaces of the shoes and the vanes for supporting both ends of the rotor urging member.

2. The valve timing regulation device according to claim 1, wherein an even number groups of advancing hydraulic chambers and retarding hydraulic chambers are formed between said wall surfaces of the vanes and the shoes, the rotor urging member is arranged in a pair of the advancing hydraulic chambers situated in an axial symmetry position of the rotor, and both ends of the rotor urging member are supported by the pair of holder members which are mounted on the wall surfaces of the shoes and the vanes situated on both sides of the advancing hydraulic chamber to sandwich the rotor urging member.

3. The valve timing regulation device according to claim 1, wherein a holder engagement portion for fitting the holder member is formed on the wall surfaces of the vane and the shoe orientated to the circumferential direction.

4. The valve timing regulation device according to claim 1, wherein said holder member is integrally formed with resin material and has an engagement hole or an engagement projection for fitting the end of the rotor urging member.

5. The valve timing regulation device according to claim 1, wherein said holder member is integrally formed with a resilient member such as hard rubber and has an engagement hole or an engagement projection for fitting the end of the rotor urging member.

6. The valve timing regulation device according to claim 1, wherein said holder member is formed with a pressed sheet metal member.

7. The valve timing regulation device according to claim 1, wherein said holder member is integrally formed by a molding process such as casting or forging of a metallic material and has an engagement hole or an engagement projection for fitting the end of the rotor urging member.

8. The valve timing regulation device according to claim 1, wherein said rotor urging member is constituted by at least two coil springs, both ends of which are supported by the pair of holder members and which are stored in the same advancing hydraulic chamber, and wherein coil wires of said coil springs have different sizes in diameter.

9. The valve timing regulation device according to claim 1, wherein said rotor urging member is constituted by at least two coil springs, both ends of which are supported by the pair of holder members and which are stored in the same advancing hydraulic chamber, and wherein said coil springs are different in the number of turns from each other.

10. The valve timing regulation device according to claim 2, wherein peripheral lengths of the shoe and the vane to be disposed on both sides of the respective advancing hydraulic chambers which store the rotor urging member, is longer than those of the shoe and the vane to be disposed on both sides of the other advancing hydraulic chambers which do not store the rotor urging member.

11. The valve timing regulation device according to claim 3, wherein said holder engagement portion is formed as axial grooves, the axial grooves allowing insertion of the holder members from one axial end.

12. The valve timing regulation device according to claim 3, wherein said holder engagement portion is formed as holes which are opened in said wall surfaces of the shoe and the vane.

13. The valve timing regulation device according to claim 3, wherein said holder engagement portion is formed as axial grooves, the axial grooves allowing insertion of the holder members from one axial end, a holder detachment prevention means is provided on at least one of the axial grooves and the holder members, the holder detachment prevention means limiting displacement of the holder members in the axial grooves with respect to a rotation direction of the device.

14. The valve timing regulation device according to claim 13, wherein the holder detachment prevention means is provided with a tapering face formed on a lateral wall surface of the holder engagement groove for gradually narrowing the groove width of the holder engagement groove towards an opened end of the groove in the rotation direction, and an another tapering face formed on a lateral wall surface of the holder member in alignment with said tapering face.

15. The valve timing regulation device according to claim 13, wherein said holder detachment prevention means is provided with a catch for preventing detachment which engages with the holder member disposed in the holder engagement groove, the catch being arranged in an opened end portion of the holder engagement groove of the shoe and the vane.

16. The valve timing regulation device according to claim 13, wherein said holder detachment prevention means is provided with engagement concavities arranged on one of the holder members and the holder engagement grooves of the shoe and the vane, and engagement protrusions arranged on the other of the holder members and the holder engagement grooves of the shoe and the vane, said engagement concavity and said engagement protrusion being engaged with each other.

17. The valve timing regulation device according to claim 13, wherein said holder detachment prevention means is provided with key grooves formed on both of the holder members and the holder engagement grooves of the shoe and the vane, and a key member inserted into both key grooves to fix the holder member in the holder engagement groove.

* * * * *